US007924233B2

(12) United States Patent
Wang et al.

(10) Patent No.: US 7,924,233 B2
(45) Date of Patent: Apr. 12, 2011

(54) THREE-DIMENSIONAL ANTENNA AND RELATED WIRELESS COMMUNICATION DEVICE

(75) Inventors: Chih-Ming Wang, Taipei Hsien (TW); Feng-Chi Eddie Tsai, Taipei Hsien (TW); Yi-Chih Wang, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 369 days.

(21) Appl. No.: 12/332,348

(22) Filed: Dec. 11, 2008

(65) Prior Publication Data

US 2009/0102729 A1 Apr. 23, 2009

Related U.S. Application Data

(63) Continuation-in-part of application No. 11/737,146, filed on Apr. 19, 2007, now Pat. No. 7,482,980.

(30) Foreign Application Priority Data

Dec. 22, 2006 (TW) ..... 95148343 A

(51) Int. Cl.
*H01Q 11/06* (2006.01)

(52) U.S. Cl. ..... 343/736; 343/700 MS; 343/702

(58) Field of Classification Search ..... 343/736, 343/700 MS, 702
See application file for complete search history.

(56) References Cited

U.S. PATENT DOCUMENTS 2,531,432 A * 11/1950 Himmel ..... 343/736
3,725,936 A * 4/1973 Sherman ..... 342/432
4,511,898 A 4/1985 Bush
5,200,756 A 4/1993 Feller
6,650,302 B2 11/2003 Sanad

* cited by examiner

*Primary Examiner* — Hoang V Nguyen
(74) *Attorney, Agent, or Firm* — Winston Hsu; Scott Margo

(57) ABSTRACT

A three-dimensional antenna includes a substrate, a radiator, a second radiator, a signal feeding element, and a grounding element. The radiator is installed on the substrate. The radiator includes a first child radiator and a second child radiator. The first child radiator has a first end and a second end. The second child radiator has a first end and a second end, wherein the second end of the second child radiator is coupled to the second end of the first child radiator. The second radiator is coupled to the radiator. The signal feeding element is coupled to the first end of the first child radiator. The grounding element is coupled between the substrate and the first end of the second child radiator. The first child radiator and the second child radiator form an inverted V-shape installed on the substrate.

22 Claims, 46 Drawing Sheets

| Frequency | Maximum value | Position | Minimum value | Position | Average |
|---|---|---|---|---|---|
| 2400 (MHz) | 3.92 dB | -42.00 deg | -17.68 dB | -177.00 deg | -2.48 dB |
| 2450 (MHz) | 3.75 dB | -45.00 deg | -17.19 dB | -177.00 deg | -2.90 dB |
| 2500 (MHz) | 4.31 dB | -45.00 deg | -16.07 dB | -174.00 deg | -2.21 dB |

FIG. 18

XZ plane

| Frequency | Maximum value | Position | Minimum value | Position | Average |
|---|---|---|---|---|---|
| 4900 (MHz) | 5.64 dB | -51.00 deg | -20.00 dB | -150.02 deg | -0.90 dB |
| 5150 (MHz) | 5.22 dB | -48.00 deg | -22.51 dB | -179.76 deg | -1.50 dB |
| 5250 (MHz) | 4.93 dB | -45.00 deg | -20.69 dB | -150.02 deg | -1.57 dB |
| 5350 (MHz) | 5.12 dB | -45.00 deg | -20.14 dB | 177.01 deg | -1.39 dB |
| 5470 (MHz) | 4.81 dB | -45.00 deg | -21.58 dB | -150.02 deg | -1.74 dB |
| 5600 (MHz) | 4.48 dB | 3.00 deg | -20.58 dB | 158.99 deg | -2.38 dB |
| 5725 (MHz) | 4.45 dB | -6.00 deg | -21.09 dB | 132.01 deg | -2.74 dB |
| 5850 (MHz) | 5.30 dB | 3.00 deg | -20.68 dB | -150.02 deg | -2.28 dB |

FIG. 20

ZX plane

XZ plane

| Frequency | Maximum value | Position | Minimum value | Position | Average |
|---|---|---|---|---|---|
| 2400 (MHz) | 1.10 dB | 45.71 deg | -19.25 dB | 148.57 deg | -3.79 dB |
| 2450 (MHz) | 1.22 dB | 48.57 deg | -20.18 dB | 151.43 deg | -3.41 dB |
| 2500 (MHz) | 0.69 dB | 51.43 deg | -18.82 dB | 151.43 deg | -3.59 dB |
| 5150 (MHz) | 0.28 dB | -17.14 deg | -25.39 dB | 165.71 deg | -5.77 dB |
| 5250 (MHz) | 0.73 dB | -14.29 deg | -22.18 dB | 165.71 deg | -5.47 dB |
| 5350 (MHz) | 1.01 dB | -34.29 deg | -19.00 dB | 165.71 deg | -4.94 dB |
| 5470 (MHz) | 1.24 dB | -11.43 deg | -20.28 dB | 100.00 deg | -4.37 dB |
| 5650 (MHz) | 1.00 dB | -34.29 deg | -21.23 dB | 162.86 deg | -4.49 dB |
| 5725 (MHz) | 1.14 dB | -31.43 deg | -22.41 dB | -168.57 deg | -4.42 dB |
| 5785 (MHz) | 0.63 dB | -2.86 deg | -25.60 dB | 162.86 deg | -4.69 dB |
| 5850 (MHz) | 1.71 dB | 0.00 deg | -28.51 dB | 162.86 deg | -4.94 dB |

FIG. 34

YZ plane

| Frequency | Maximum value | Position | Minimum value | Position | Average |
|---|---|---|---|---|---|
| 2400 (MHz) | 1.62 dB | -28.57 deg | -6.14 dB | 177.14 deg | -1.99 dB |
| 2450 (MHz) | 1.59 dB | -28.57 deg | -7.03 dB | 174.29 deg | -2.00 dB |
| 2500 (MHz) | 1.51 dB | -31.43 deg | -8.70 dB | 177.14 deg | -2.44 dB |
| 5150 (MHz) | 3.22 dB | 42.86 deg | -17.98 dB | -180.00 deg | -2.93 dB |
| 5250 (MHz) | 3.29 dB | 51.43 deg | -13.34 dB | -162.86 deg | -2.84 dB |
| 5350 (MHz) | 3.27 dB | 42.86 deg | -15.88 dB | -177.14 deg | -2.77 dB |
| 5470 (MHz) | 4.12 dB | 54.29 deg | -13.12 dB | -160.00 deg | -2.23 dB |
| 5650 (MHz) | 3.40 dB | 54.29 deg | -16.45 dB | -180.00 deg | -3.03 dB |
| 5725 (MHz) | 3.87 dB | 54.29 deg | -13.74 dB | -160.00 deg | -2.60 dB |
| 5785 (MHz) | 3.84 dB | 54.29 deg | -16.12 dB | -162.86 deg | -3.00 dB |
| 5850 (MHz) | 3.53 dB | 54.29 deg | -23.68 dB | -162.86 deg | -3.12 dB |

FIG. 36

XZ plane

| Frequency | Maximum value | Position | Minimum value | Position | Average |
|---|---|---|---|---|---|
| 5150 (MHz) | -1.06 dB | -48.57 deg | -17.81 dB | -180.00 deg | -4.98 dB |
| 5250 (MHz) | -0.91 dB | -51.43 deg | -18.64 dB | -180.00 deg | -5.00 dB |
| 5350 (MHz) | -0.37 dB | -51.43 deg | -16.65 dB | -180.00 deg | -4.99 dB |
| 5470 (MHz) | 0.43 dB | -48.57 deg | -17.91 dB | 5.71 deg | -4.52 dB |
| 5600 (MHz) | 0.46 dB | -48.57 deg | -19.40 dB | 2.86 deg | -4.66 dB |
| 5725 (MHz) | 0.48 dB | -45.71 deg | -18.86 dB | 2.86 deg | -4.81 dB |
| 5785 (MHz) | -0.14 dB | -48.57 deg | -18.35 dB | 5.71 deg | -5.14 dB |
| 5850 (MHz) | 0.03 dB | -51.43 deg | -21.23 dB | -177.14 deg | -5.04 dB |

FIG. 44

YZ plane

| Frequency | Maximum value | Position | Minimum value | Position | Average |
|---|---|---|---|---|---|
| 5150 (MHz) | 1.84 dB | 122.86 deg | -18.16 dB | 177.14 deg | -2.85 dB |
| 5250 (MHz) | 1.35 dB | 125.71 deg | -18.64 dB | -180.00 deg | -2.74 dB |
| 5350 (MHz) | 1.02 dB | -131.43 deg | -16.65 dB | -180.00 deg | -2.53 dB |
| 5470 (MHz) | 1.32 dB | -134.29 deg | -15.59 dB | 2.86 deg | -2.05 dB |
| 5600 (MHz) | 0.72 dB | -134.29 deg | -17.80dB | 2.86 deg | -2.34 dB |
| 5725 (MHz) | 0.66 dB | 108.57 deg | -18.64 dB | 2.86 deg | -2.29 dB |
| 5785 (MHz) | 0.57 dB | 91.43 deg | -16.65 dB | -177.14 deg | -2.65 dB |
| 5850 (MHz) | 1.06 dB | 102.86 deg | -20.98 dB | -177.14 deg | -2.53 dB |

FIG. 46

THREE-DIMENSIONAL ANTENNA AND RELATED WIRELESS COMMUNICATION DEVICE

CROSS REFERENCE TO RELATED APPLICATIONS

This is a continuation-in-part of U.S. application Ser. No. 11/737,146, which was filed on Apr. 19, 2007 and is included herein by reference.

BACKGROUND OF THE INVENTION

1. Field of the Invention

The present invention relates to a three-dimensional antenna and a related wireless communication device, and more particularly, to a three-dimensional antenna and related wireless communication device having a metal sheet with an inverted V-shape installed on a substrate.

2. Description of the Prior Art

As wireless telecommunication develops with the trend of micro-sized mobile communication products, the location and the space arranged for antennas are limited. Therefore, some built-in micro antennas have been developed. Currently, micro antennas such as chip antennas, planar antennas etc are commonly used. All these antennas have the feature of small volume. Additionally, planar antennas are also designed in many types such as micro-strip antennas, printed antennas and planar inverted F antennas. These antennas are widespread, being applied to GSM, DCS, UMTS, WLAN, Bluetooth, etc.

With the improvement of data transmission speed in wireless communication systems, multi-frequency or wideband antennas have become a basic requirement of communication systems. How to reduce sizes of the antennas, improve antenna efficiency, and improve impedance matching becomes an important consideration in the field. Cost of conventional wideband antennas is unable to be reduced effectively, and their radiation patterns and operational frequency are difficult to control, restricting their application ranges.

SUMMARY OF THE INVENTION

It is one of the objectives of the present invention to provide a three-dimensional antenna and a related wireless communication device to solve the abovementioned problems.

According to an exemplary embodiment of the present invention, a three-dimensional antenna is provided. The three-dimensional antenna includes a substrate, a radiator, a second radiator, a signal feeding element, and a grounding element. The radiator is installed on the substrate. The radiator includes a first child radiator and a second child radiator. The first child radiator has a first end and a second end. The second child radiator has a first end and a second end, wherein the second end of the second child radiator is coupled to the second end of the first child radiator. The second radiator is coupled to the radiator. The signal feeding element is coupled to the first end of the first child radiator. The grounding element is coupled between the substrate and the first end of the second child radiator. The first child radiator and the second child radiator form an inverted V-shape installed on the substrate. The second radiator is coupled to the first child radiator of the radiator or is to the second child radiator of the radiator. The second radiator can has at least one bend.

According to another exemplary embodiment of the present invention, a three-dimensional antenna is provided.

The three-dimensional antenna includes a radiator, a grounding element, and a signal feeding element. The substrate has a first end and a second end. The radiator includes a first child radiator and a second child radiator. The first child radiator has a first end and a second end. The second child radiator has a first end and a second end, wherein the second end of the second child radiator is coupled to the second end of the first child radiator. The grounding element is coupled between the first end of the substrate and the first end of the second child radiator to form a designated spacing by bending the substrate. The signal feeding element is coupled to the first end of the first child radiator. The first child radiator and the second child radiator form an inverted V-shape installed on the substrate. The substrate, the first child radiator, the second child radiator, the grounding element, and the signal feeding element are monolithically formed together. The substrate, the first child radiator, the second child radiator, the grounding element, and the signal feeding element are substantially composed of a single metal sheet.

According to another exemplary embodiment of the present invention, a wireless communication device with three-dimensional antennas is provided. The wireless communication device includes a system circuit and a plurality of three-dimensional antennas coupled to the system circuit. Each three-dimensional antenna includes a substrate, a radiator, a second radiator, a signal feeding element, and a grounding element. The radiator is installed on the substrate. The radiator includes a first child radiator and a second child radiator. The first child radiator has a first end and a second end. The second child radiator has a first end and a second end, wherein the second end of the second child radiator is coupled to the second end of the first child radiator. The second radiator is coupled to the radiator. The signal feeding element is coupled to the first end of the first child radiator. The grounding element is coupled between the substrate and the first end of the second child radiator. The first child radiator and the second child radiator form an inverted V-shape installed on the substrate.

According to another exemplary embodiment of the present invention, a wireless communication device with three-dimensional antennas is provided. The wireless communication device includes a system circuit and a plurality of three-dimensional antennas coupled to the system circuit. Each three-dimensional antenna includes a radiator, a grounding element, and a signal feeding element. The substrate has a first end and a second end. The radiator includes a first child radiator and a second child radiator. The first child radiator has a first end and a second end. The second child radiator has a first end and a second end, wherein the second end of the second child radiator is coupled to the second end of the first child radiator. The grounding element is coupled between the first end of the substrate and the first end of the second child radiator to form a designated spacing by bending the substrate. The signal feeding element is coupled to the first end of the first child radiator. The first child radiator and the second child radiator form an inverted V-shape installed on the substrate. The substrate, the first child radiator, the second child radiator, the grounding element, and the signal feeding element are monolithically formed together. The substrate, the first child radiator, the second child radiator, the grounding element, and the signal feeding element are substantially composed of a single metal sheet.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 18 is a diagram showing the positions and the values of the maximum values and the minimum values in FIG. 17.

FIG. 20 is a diagram showing the positions and the values of the maximum values and the minimum values in FIG. 19.

FIG. 34 is a diagram showing the positions and the values of the maximum values and the minimum values in FIG. 33.

FIG. 36 is a diagram showing the positions and the values of the maximum values and the minimum values in FIG. 35.

FIG. 44 is a diagram showing the positions and the values of the maximum values and the minimum values in FIG. 43.

FIG. 46 is a diagram showing the positions and the values of the maximum values and the minimum values in FIG. 45.

DETAILED DESCRIPTION

Figure 1:
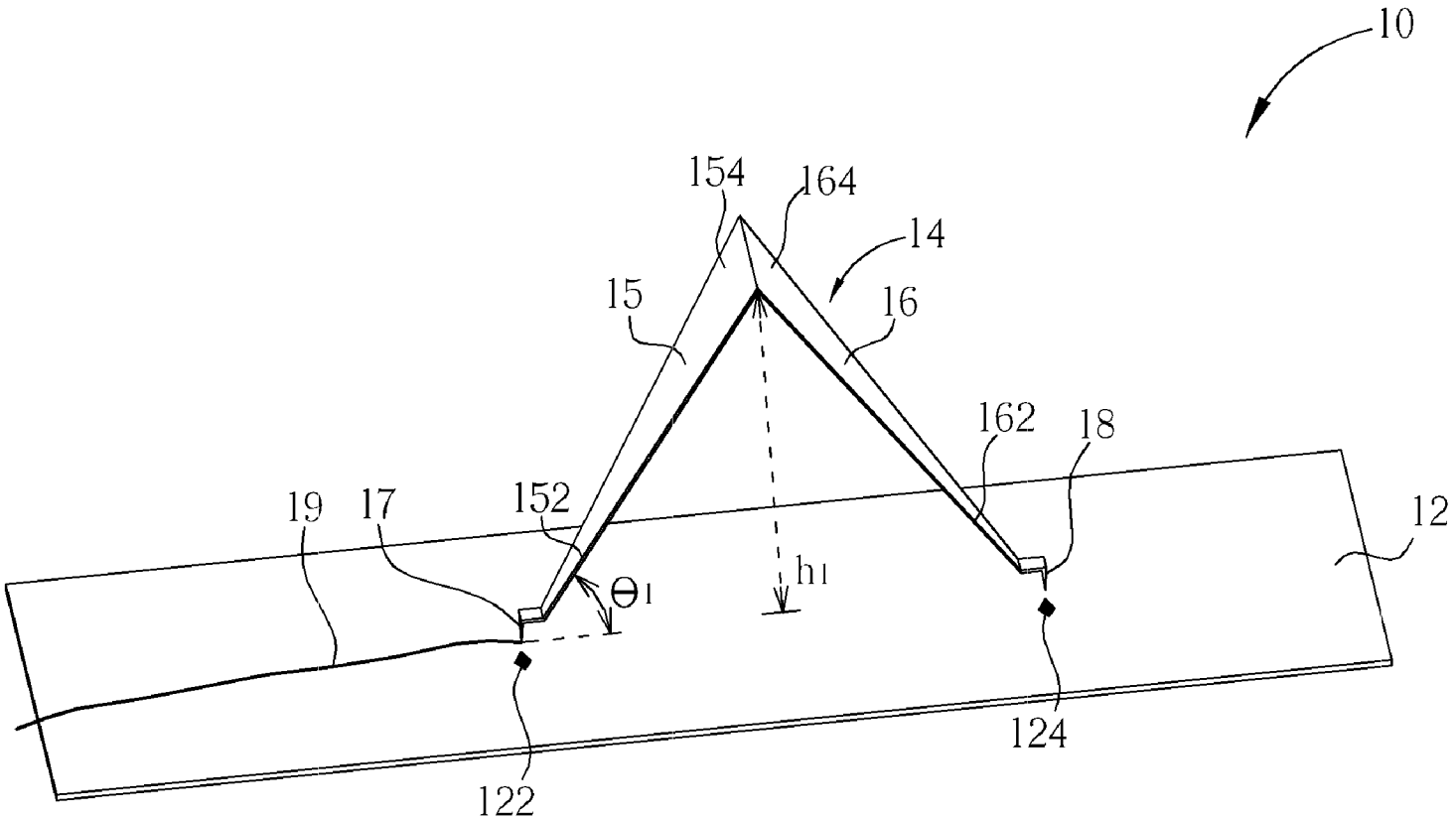
FIG. 1 is a diagram of a three-dimensional wideband antenna according to an embodiment of the present invention.

Please refer to FIG. 1, which is a diagram of a three-dimensional wideband antenna 10 according to an embodiment of the present invention. The wideband antenna 10 includes a substrate 12, a radiator 14, a signal feeding element 17, and a grounding element 18. The substrate 12 includes a signal feeding point 122 and a grounding point 124. The radiator 14 includes a first child radiator 15 and a second child radiator 16. The first child radiator 15 has a first end 152 and a second end 154. The second child radiator 16 has a first end 162 and a second end 164, where the second end 164 of the second child radiator 16 is connected to the second end 154 of the first child radiator 15. The signal feeding element 17 is connected between the signal feeding point 122 and the first end 152 of the first child radiator 15. The grounding element 18 is connected between the grounding point 124 and the first end 162 of the second child radiator 16. The signal feeding element 17 is connected to a signal line 19 for receiving an input signal. Preferably, the first child radiator 15 and the second child radiator 16 are substantially composed of a single metal sheet. In this embodiment, the first child radiator 15 and the second child radiator 16 are formed by bending a rhombus metal sheet along a diagonal of the rhombus metal sheet, which forms the first child radiator 15 and the second child radiator 16 into an inverted V-shape installed on the substrate 12. An angle between the first end 152 of the first child radiator 15 and the substrate 12 is a first angle $\theta_1$, and a distance between the second end 154 of the first child radiator 15 and the substrate 12 is a first height $h_1$. The present invention can adjust operational frequencies and radiation patterns of the wideband antenna 10 by changing the first angle $\theta_1$ and the first height $h_1$, and this will be explained in the following. The substrate 12 comprises dielectric material and is connected to a system ground terminal electrically. Preferably, the substrate 12 is a thin metal plane. The wideband antenna 10 is installed inside a wireless communication device, such as a wireless access point (WAP).

Figure 2:
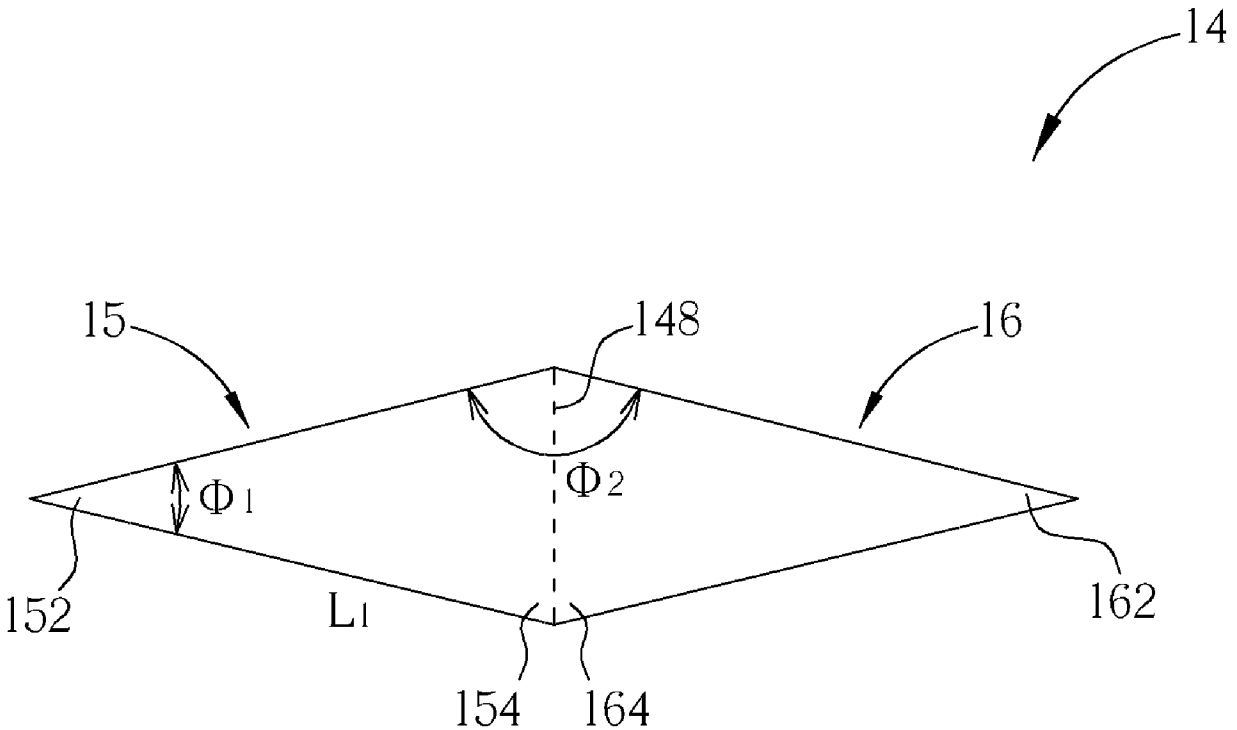
FIG. 2 is a diagram illustrating the radiator of the wideband antenna in FIG. 1.

Please refer to FIG. 2 and FIG. 1. FIG. 2 is a diagram illustrating the radiator 14 of the wideband antenna 10 in FIG. 1. The radiator 14 is a rhombus metal sheet, and the first child radiator 15 and the second child radiator 16 are formed by bending the rhombus metal sheet along a diagonal 148 of the rhombus metal sheet. Hence, the first child radiator 15 and the second child radiator 16 are each approximately a tapered width plane, whereof a width of the first end 152 of the first child radiator 15 is smaller than a width of the second end 154 of the first child radiator 15 and a width of the first end 162 of the second child radiator 16 is smaller than a width of the second end 164 of the second child radiator 16. An edge length of the rhombus metal sheet is a first length $L_1$, a first interior angle $\phi_1$ is formed by the two sides of the first child radiator 15, and a second interior angle $\phi_2$ is formed by one side of the first child radiator 15 and one side of the second radiator 16. In this embodiment, the first interior angle $\phi_1$ is smaller than 90 degrees and the second interior angle $\phi_2$ is greater than 90 degrees. The first length $L_1$ is approximately one quarter of a wavelength of a resonance mode generated by the wideband antenna 10.

Figure 3:
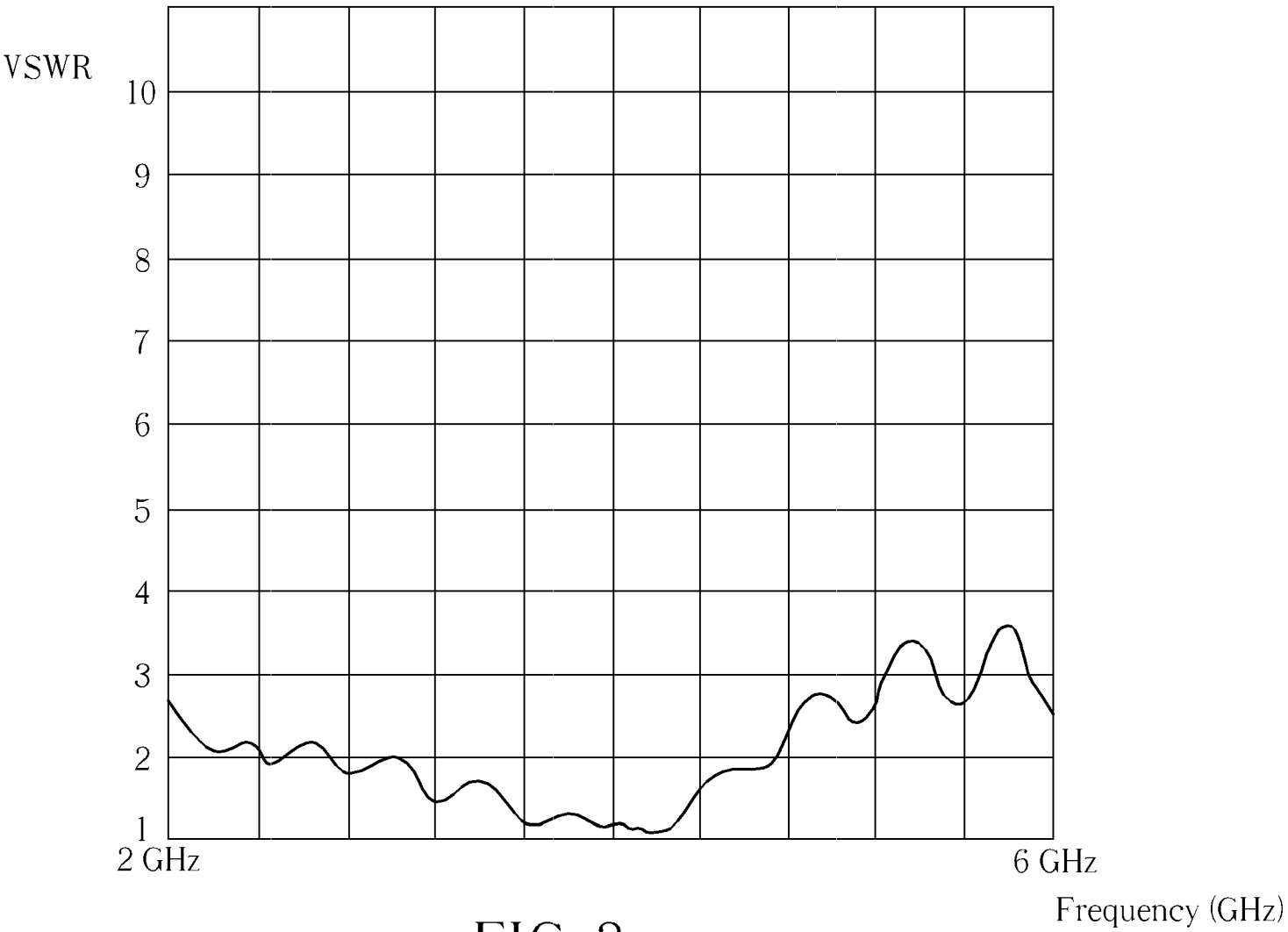
FIG. 3 is a diagram illustrating a first VSWR of the wideband antenna in FIG. 1.

Please refer to FIG. 3 and FIG. 1. FIG. 3 is a diagram illustrating a first VSWR of the wideband antenna 10 in FIG. 1. The horizontal axis represents frequency (GHz) that distributes from 2 GHz to 6 GHz, and the vertical axis represents VSWR. FIG. 3 shows the VSWR of the wideband antenna 10 when the first angle $\theta_1$ falls between 10 degrees and 30 degrees ($10° < \theta_1 < 30°$). When the VSWR is smaller than 2, the bandwidth of the wideband antenna 10 will be about 2 GHz.

Figure 4:
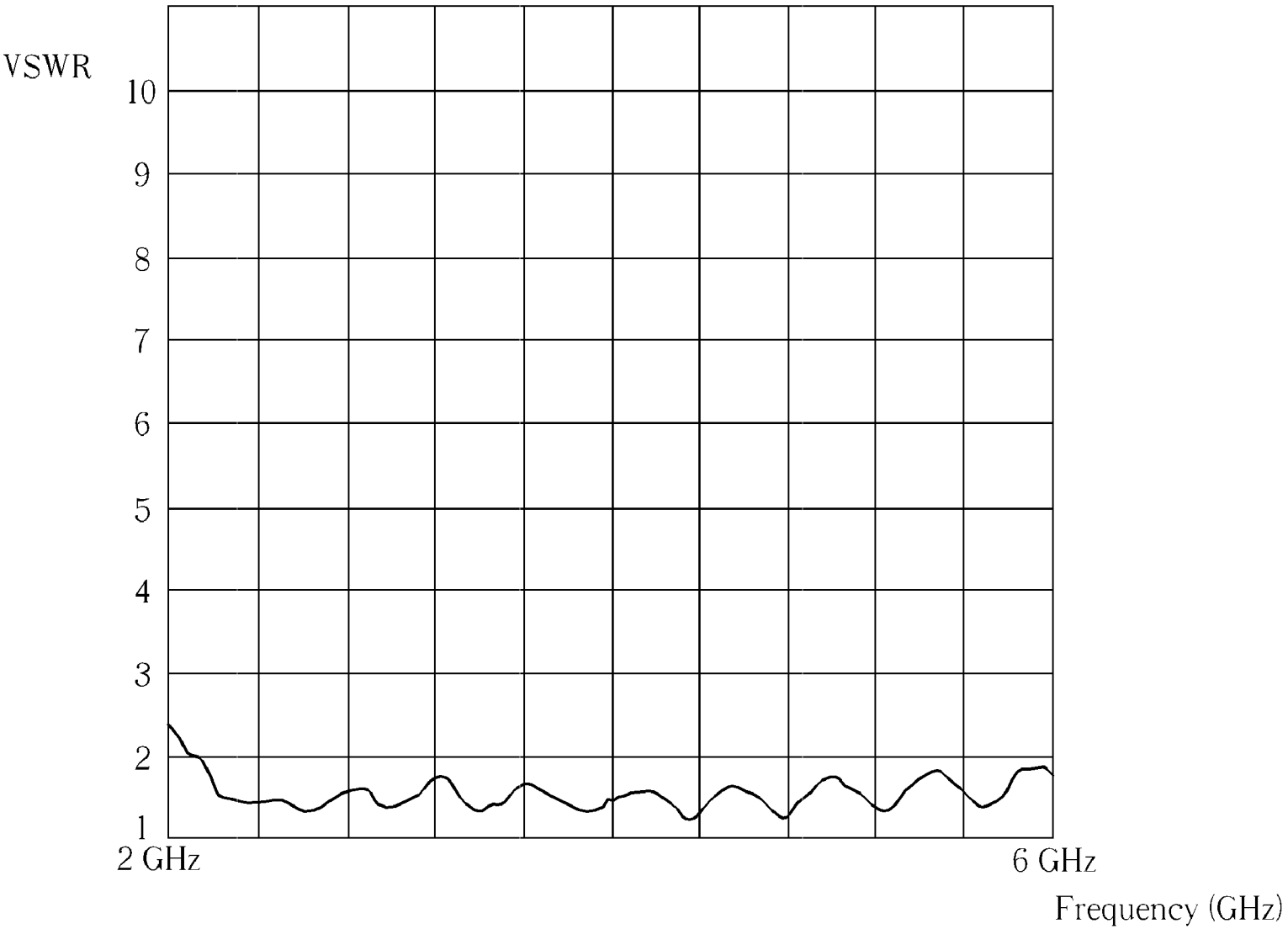
FIG. 4 is a diagram illustrating a second VSWR of the wideband antenna in FIG. 1.

Please refer to FIG. 4 and FIG. 1. FIG. 4 is a diagram illustrating a second VSWR of the wideband antenna 10 in FIG. 1. The horizontal axis represents frequency (GHz) that distributes from 2 GHz to 6 GHz, and the vertical axis represents VSWR. FIG. 4 shows the VSWR of the wideband antenna 10 when the first angle $\theta_1$ is greater than 35 degrees ($\theta_1 > 35°$). When the VSWR is smaller than 2, the bandwidth of the wideband antenna 10 will be about 4 GHz, which improves on the VSWR in FIG. 3.

Figure 5:
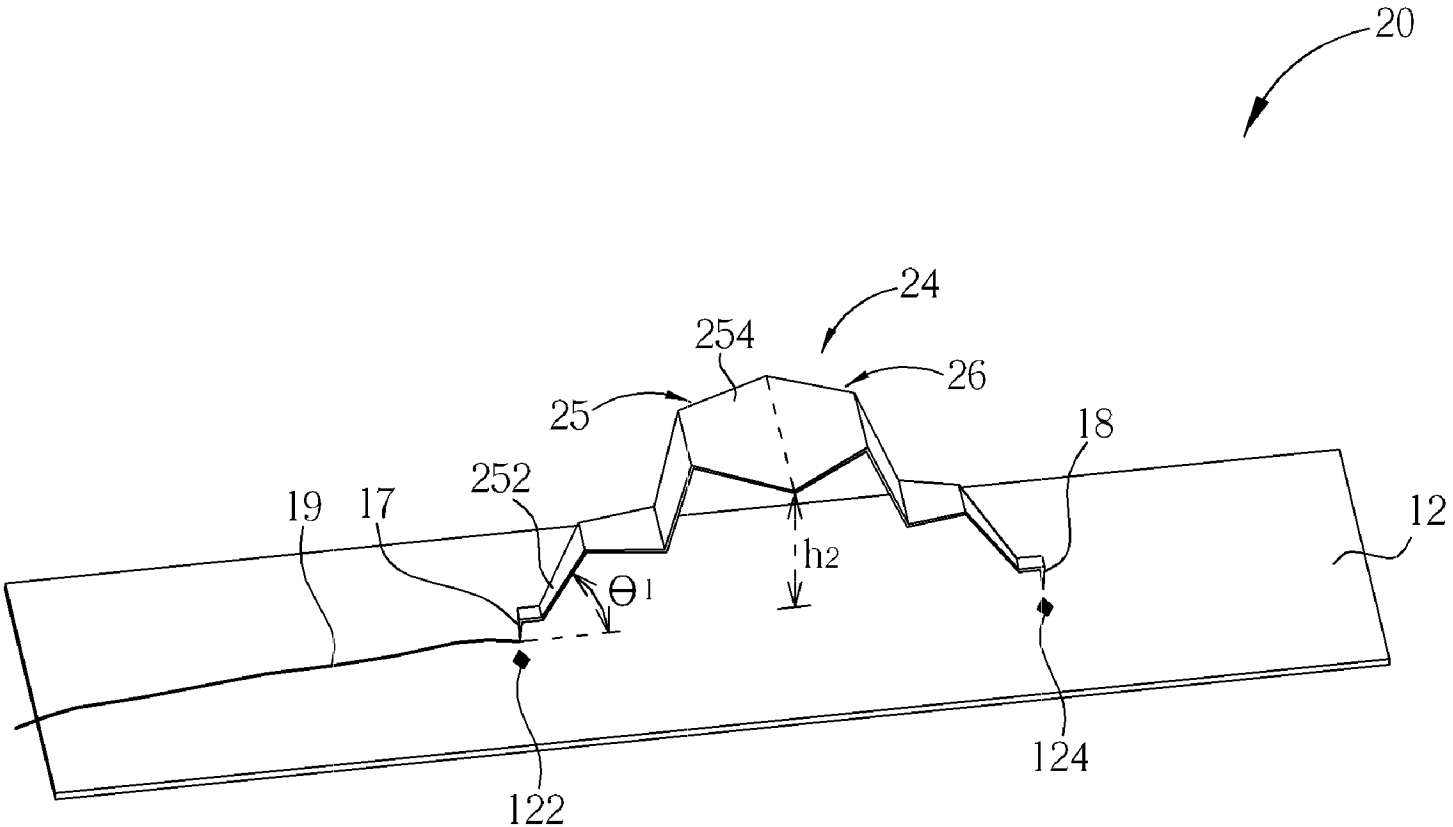
FIG. 5 is a diagram of a three-dimensional wideband antenna according to another embodiment of the present invention.
Figure 6:
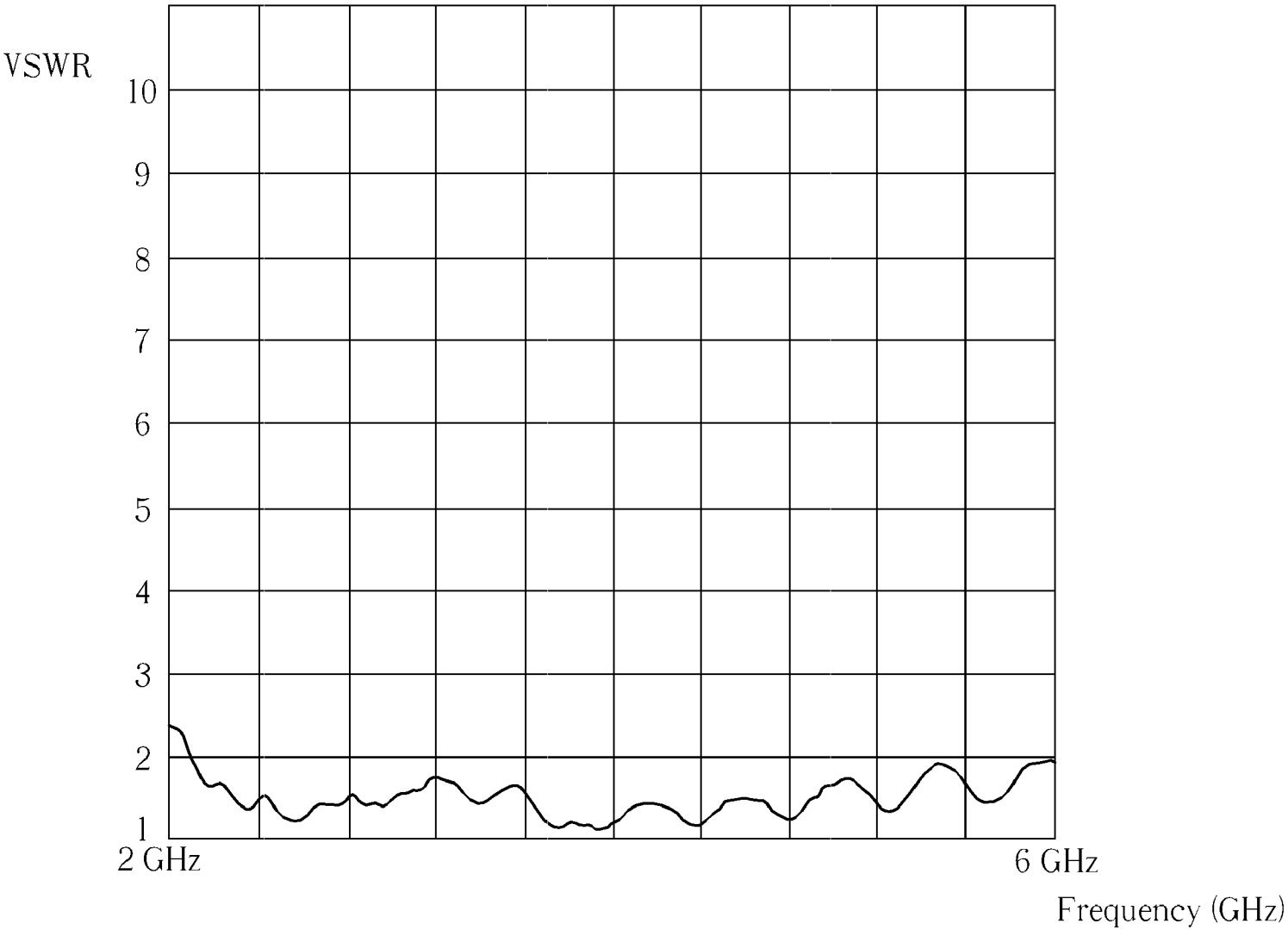
FIG. 6 is a diagram illustrating the VSWR of the wideband antenna in FIG. 5.

The wideband antenna 10 shown in FIG. 1 is merely an embodiment of the present invention, and, as is well known by a person of ordinary skill in the art, suitable variations can be applied to the wideband antenna 10. For example, several bends can be formed individually on the first child radiator 15 and the second child radiator 16. Please refer to FIG. 5 and FIG. 6. FIG. 5 is a diagram of a three-dimensional wideband antenna 20 according to another embodiment of the present invention, and FIG. 6 is a diagram illustrating the VSWR of the wideband antenna 20 in FIG. 5. The architecture of the wideband antenna 20 is similar to the wideband antenna 10 in FIG. 1, which is a changed form of the wideband antenna 10. Please note that the difference between the two structures is that a radiator 24 of the wideband antenna 20 includes a first child radiator 25 and a second child radiator 26 each including several bends. If an angle between a first end 252 of the first child radiator 25 and the substrate 12 is still the first angle $\theta_1$, a distance (a second height $h_2$) between a second end 254 of the first child radiator 25 and the substrate 12 will be smaller than the first height $h_1$ in FIG. 1 due to the first child radiator 25 and the second child radiator 26 each including several bends. In FIG. 6, the horizontal axis represents frequency (GHz) that distributes from 2 GHz to 6 GHz, and the vertical axis represents VSWR. Due to the wideband antenna 20 being the changed form of the wideband antenna 10 and the distance between the second end 254 of the first child radiator 25 and the substrate 12 being smaller than the first height $h_1$ in FIG. 1, the VSWR in FIG. 6 is different from the VSWR in FIG. 3 and in FIG. 4, wherein different VSWRs can be applied according to different system demands.

It should be noted that the bends in the first child radiator 25 and the second child radiator 26 are not limited to be a specific amount or shape.

Figure 7:
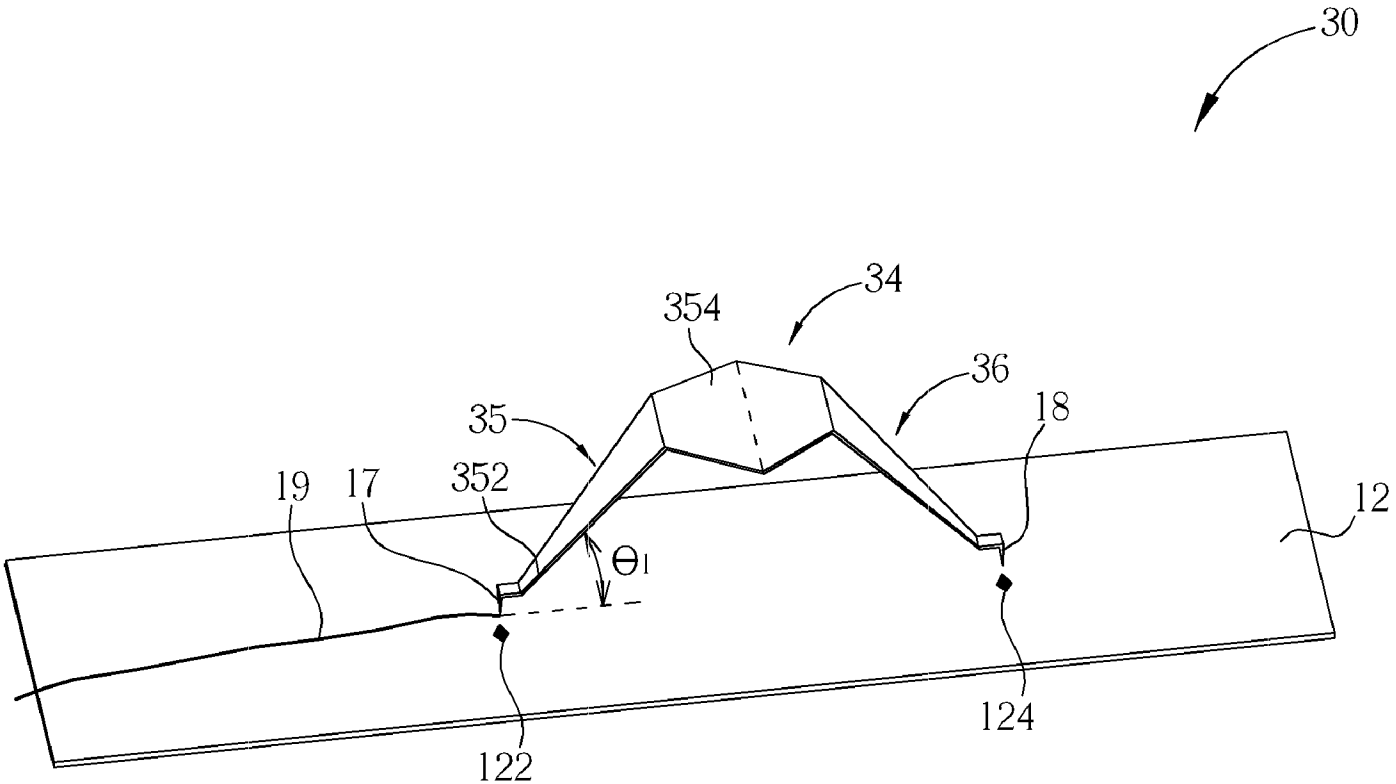
FIG. 7 is a diagram of a three-dimensional wideband antenna according to another embodiment of the present invention.
Figure 8:
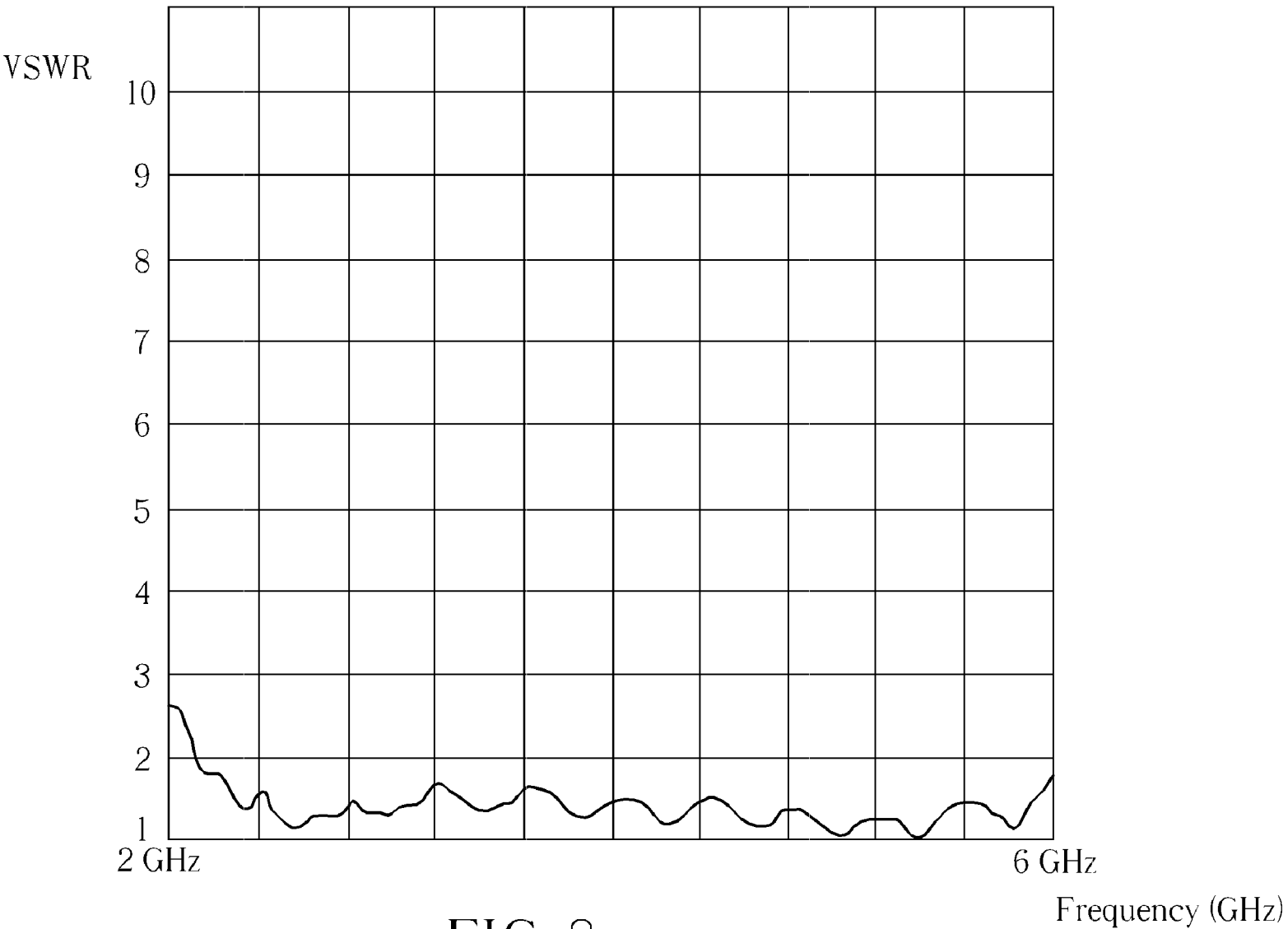
FIG. 8 is a diagram illustrating the VSWR of the wideband antenna in FIG. 7.

Please refer to FIG. 7 and FIG. 8. FIG. 7 is a diagram of a three-dimensional wideband antenna 30 according to another embodiment of the present invention. FIG. 8 is a diagram illustrating the VSWR of the wideband antenna 30 in FIG. 7. The architecture of the wideband antenna 30 is similar to the wideband antenna 10 in FIG. 1, which is a changed form of the wideband antenna 10. Please note that the difference between the two structures is that a radiator 34 of the wideband antenna 30 includes a first child radiator 35 and a second child radiator 36 each including a bend, where the amount of the bends is different from the amount of bends of the wideband antenna 20. If an angle between a first end 352 of the first child radiator 35 and the substrate 12 is still the first angle $\theta_1$, a distance between a second end 354 of the first child radiator 35 and the substrate 12 is smaller than the first height $h_1$ in FIG. 1 due to the first child radiator 35 and the second child radiator 36 each including a bend. In FIG. 8, the horizontal axis represents frequency (GHz) that distributes from 2 GHz to 6 GHz, and the vertical axis represents VSWR. Due to the wideband antenna 30 being the changed form of the wideband antenna 10 and the distance between the second end 354 of the first child radiator 35 and the substrate 12 being smaller than the first height $h_1$ in FIG. 1, the VSWR in FIG. 8 is different from the VSWR in FIG. 3 and in FIG. 4, and the different VSWRs can be applied to different system demands. Due to the amount of bends included by the wideband antenna 30 being different from the amount of bends included by the wideband antenna 20, the VSWR in FIG. 8 is different from the VSWR in FIG. 6.

Figure 9:
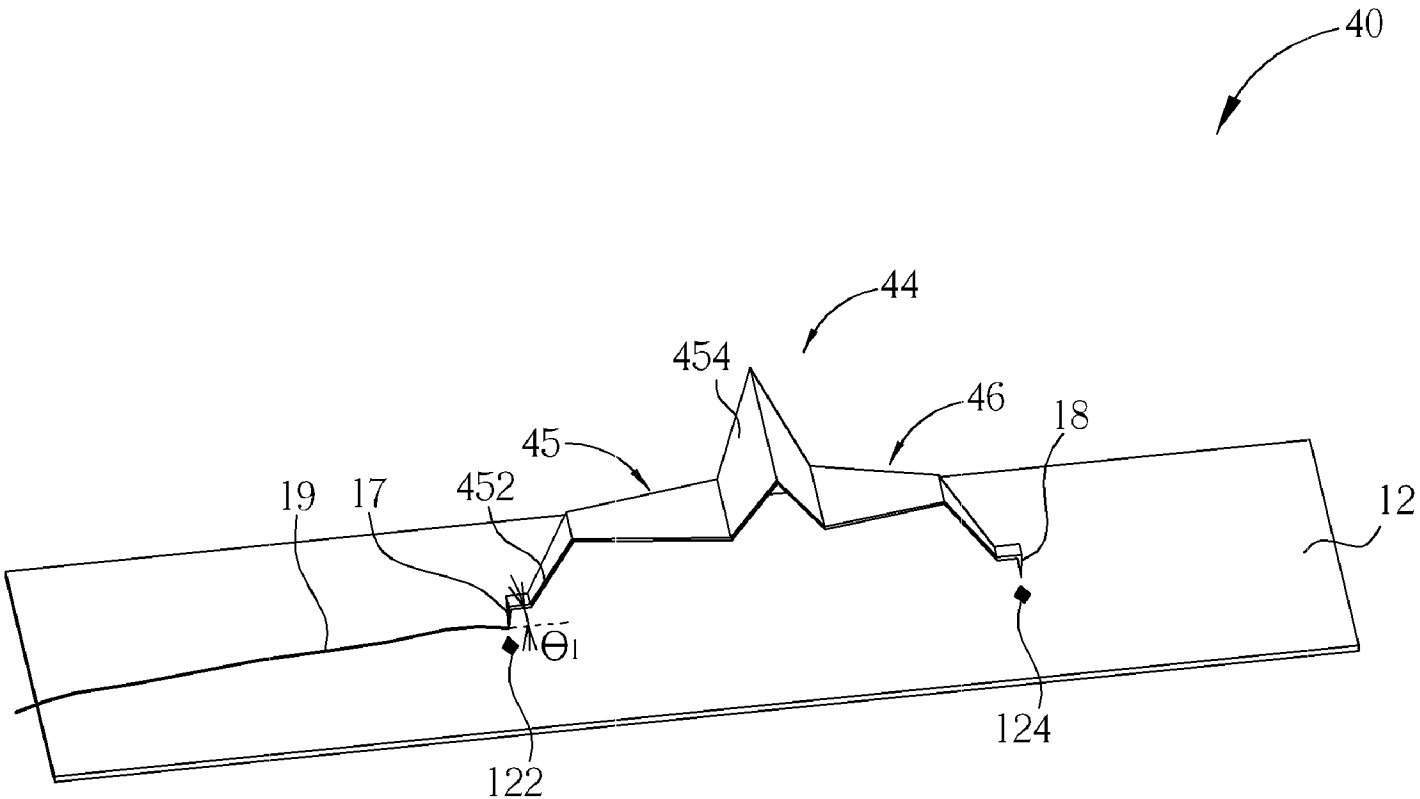
FIG. 9 is a diagram of a three-dimensional wideband antenna according to another embodiment of the present invention.
Figure 10:
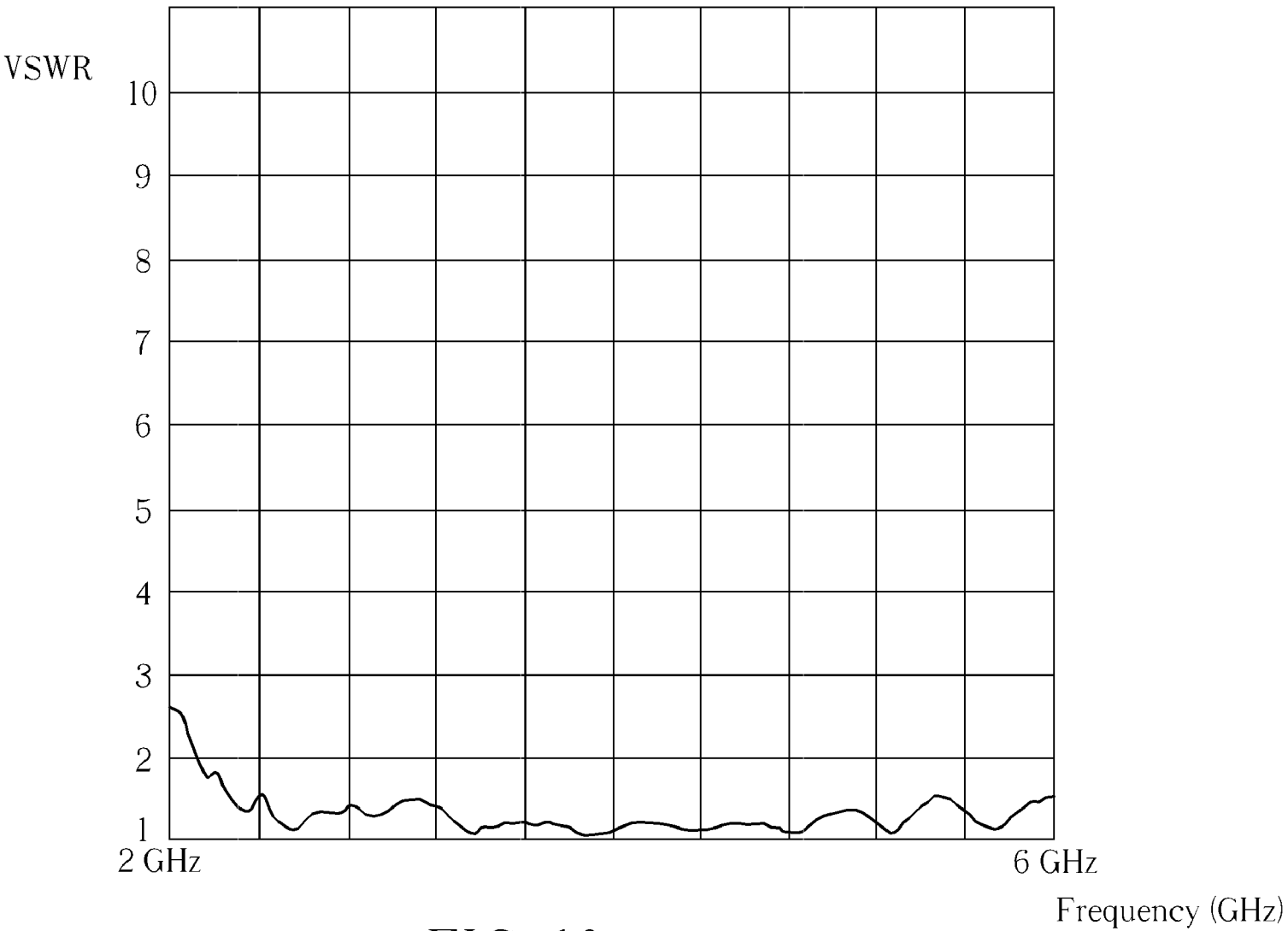
FIG. 10 is a diagram illustrating the VSWR of the wideband antenna in FIG. 9.

Please refer to FIG. 9 and FIG. 10. FIG. 9 is a diagram of a three-dimensional wideband antenna 40 according to another embodiment of the present invention. FIG. 10 is a diagram illustrating the VSWR of the wideband antenna 40 in FIG. 9. The architecture of the wideband antenna 40 is similar to the wideband antenna 10 in FIG. 1, which is a changed form of the wideband antenna 10. Please note that the difference between the two structures is that a radiator 44 of the wideband antenna 40 includes a first child radiator 45 and a second child radiator 46 each including several bends, where the amount and the shape of the bends is different from the amount and the shape of the bends of the wideband antenna 20 and 30. If an angle between a first end 452 of the first child radiator 45 and the substrate 12 is still the first angle $\theta_1$, a distance between a second end 454 of the first child radiator 45 and the substrate 12 will be smaller than the first height $h_1$ in FIG. 1 due to the first child radiator 45 and the second child radiator 46 each including several bends. In FIG. 10, the horizontal axis represents frequency (GHz) that distributes from 2 GHz to 6 GHz, and the vertical axis represents VSWR. Due to the wideband antenna 40 being the changed form of the wideband antenna 10, the VSWR in FIG. 10 is different from the VSWR in FIG. 3 and in FIG. 4, and can be applied according to different system demands. Due to the amount and the shape of bends included by the wideband antenna 40 being different from the amount and the shape of bends included by the wideband antenna 20 and 30, the VSWR in FIG. 10 is different from the VSWR in FIG. 6 and in FIG. 8.

Figure 11:
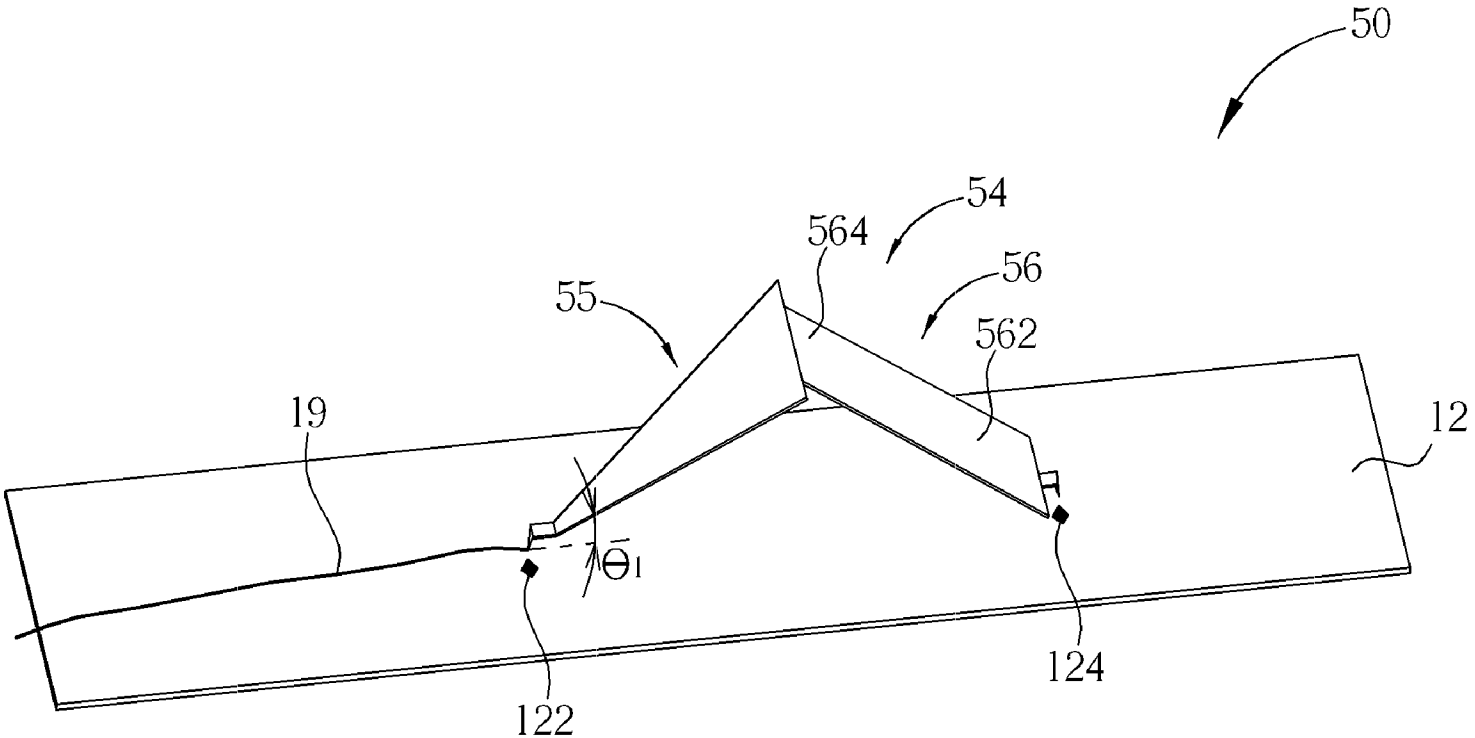
FIG. 11 is a diagram of a three-dimensional wideband antenna according to another embodiment of the present invention.

Please refer to FIG. 11, which is a diagram of a three-dimensional wideband antenna 50 according to another embodiment of the present invention. A radiator 54 of the wideband antenna 50 includes a first child radiator 55 and a second child radiator 56, a difference between the wideband antenna 50 and the wideband antenna 10 in FIG. 1 being that the second child radiator 56 of the wideband antenna 50 is approximately a rectangle, and a width of a first end 562 and a width of a second end 564 is not restricted. Please note that this embodiment is merely used for illustration, and the shape of the second child radiator 56 can be other shapes and is not limited to the rectangle.

Figure 12:
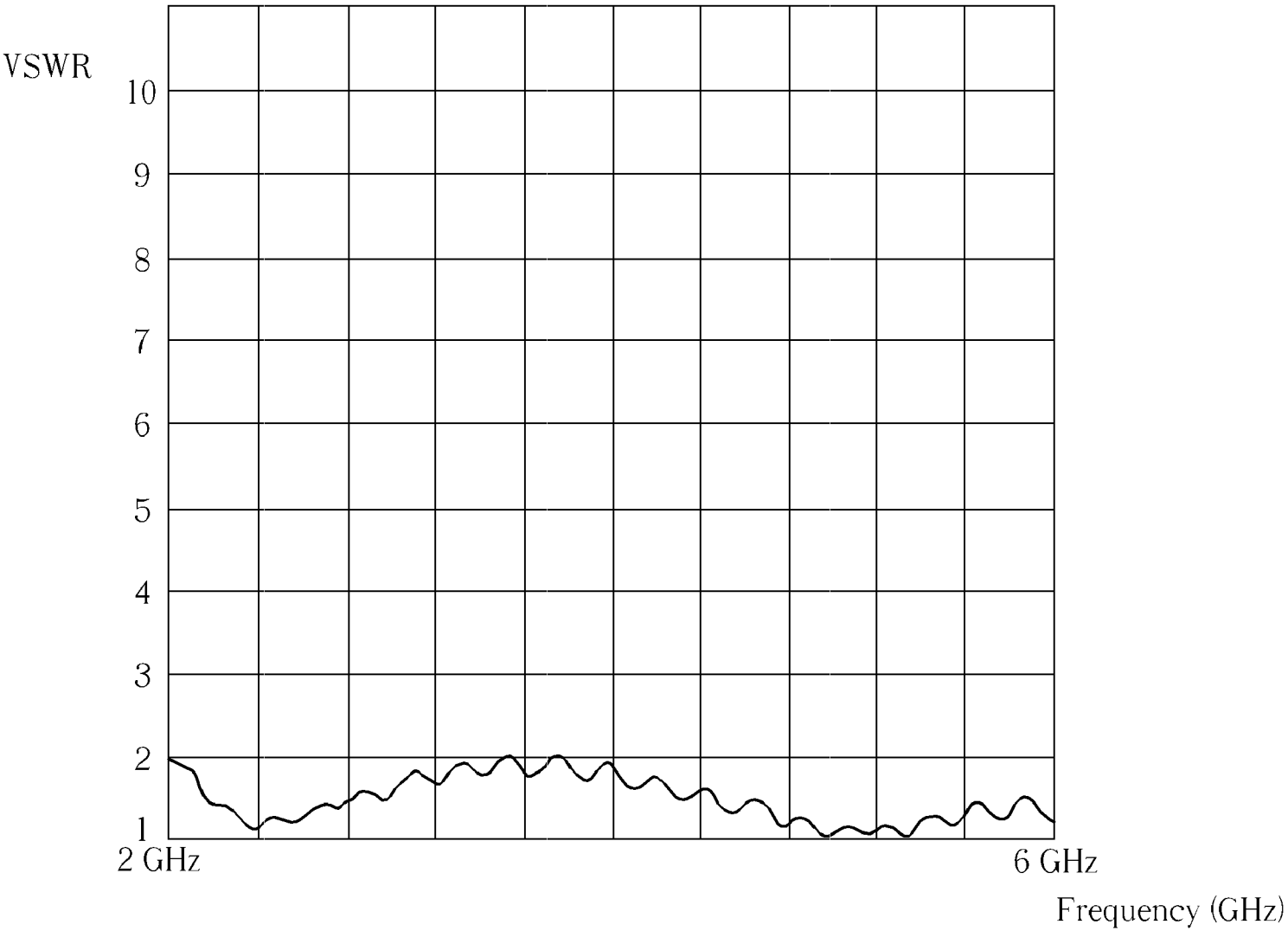
FIG. 12 is a diagram illustrating the VSWR of the wideband antenna in FIG. 11.

Please refer to FIG. 12 and FIG. 11. FIG. 12 is a diagram illustrating the VSWR of the wideband antenna 50 in FIG. 11. The horizontal axis represents frequency (GHz) that distributes from 2 GHz to 6 GHz, and the vertical axis represents VSWR. Due to the wideband antenna 50 being the changed form of the wideband antenna 10, the VSWR in FIG. 12 is different from the VSWR in FIG. 3 and in FIG. 4, and different VSWRs can be applied according to different system demands.

Figure 13:
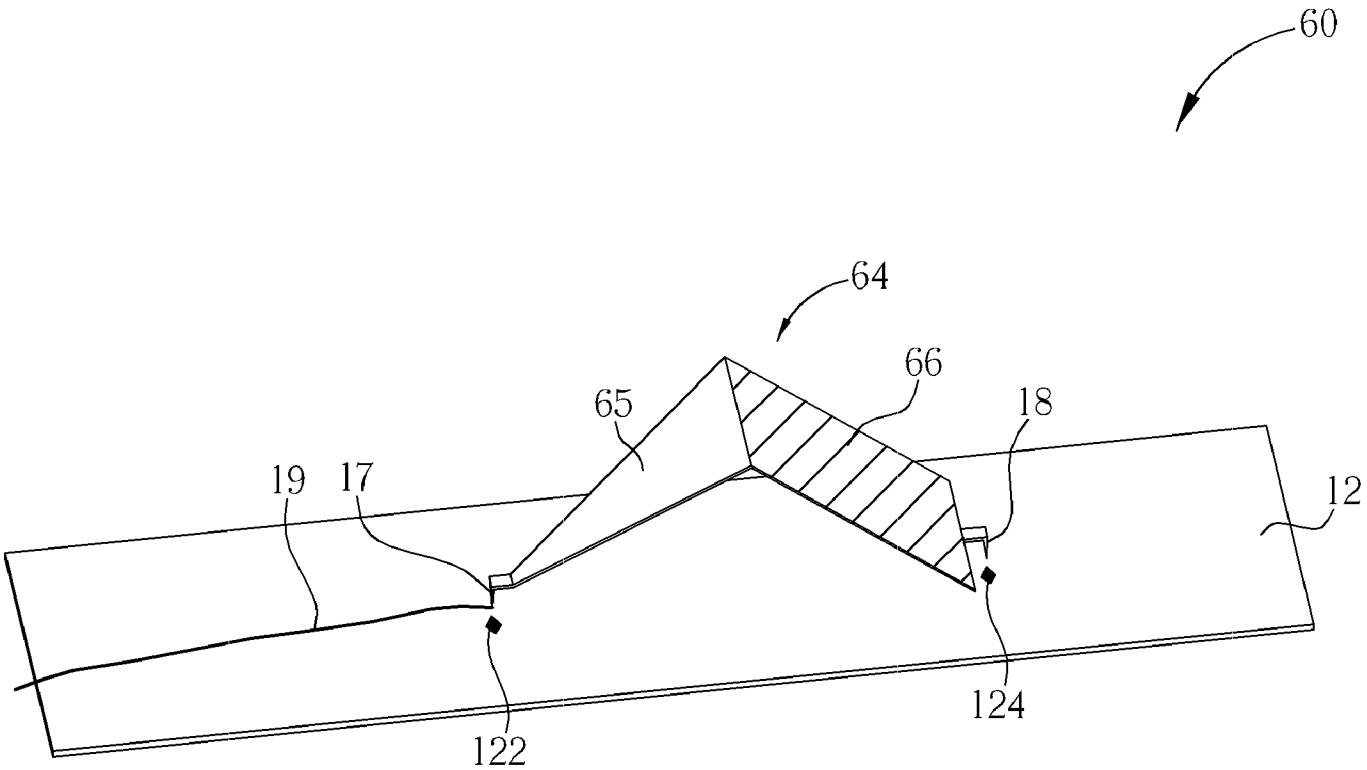
FIG. 13 is a diagram of a three-dimensional wideband antenna according to another embodiment of the present invention.

Please refer to FIG. 13, which is a diagram of a three-dimensional wideband antenna 60 according to another embodiment of the present invention. A radiator 64 of the wideband antenna 60 includes a first child radiator 65 and a second child radiator 66, a difference between the wideband antenna 60 and the wideband antenna 10 in FIG. 1 being that the second child radiator 66 of the wideband antenna 60 is a conductor paste, and the second child radiator 66 and the first child radiator 65 are not formed by a single metal sheet. Please note that the embodiment is merely used for illustration, and the shape and the material of the second child radiator 66 are not limited and can be other shapes or other materials.

Figure 14:
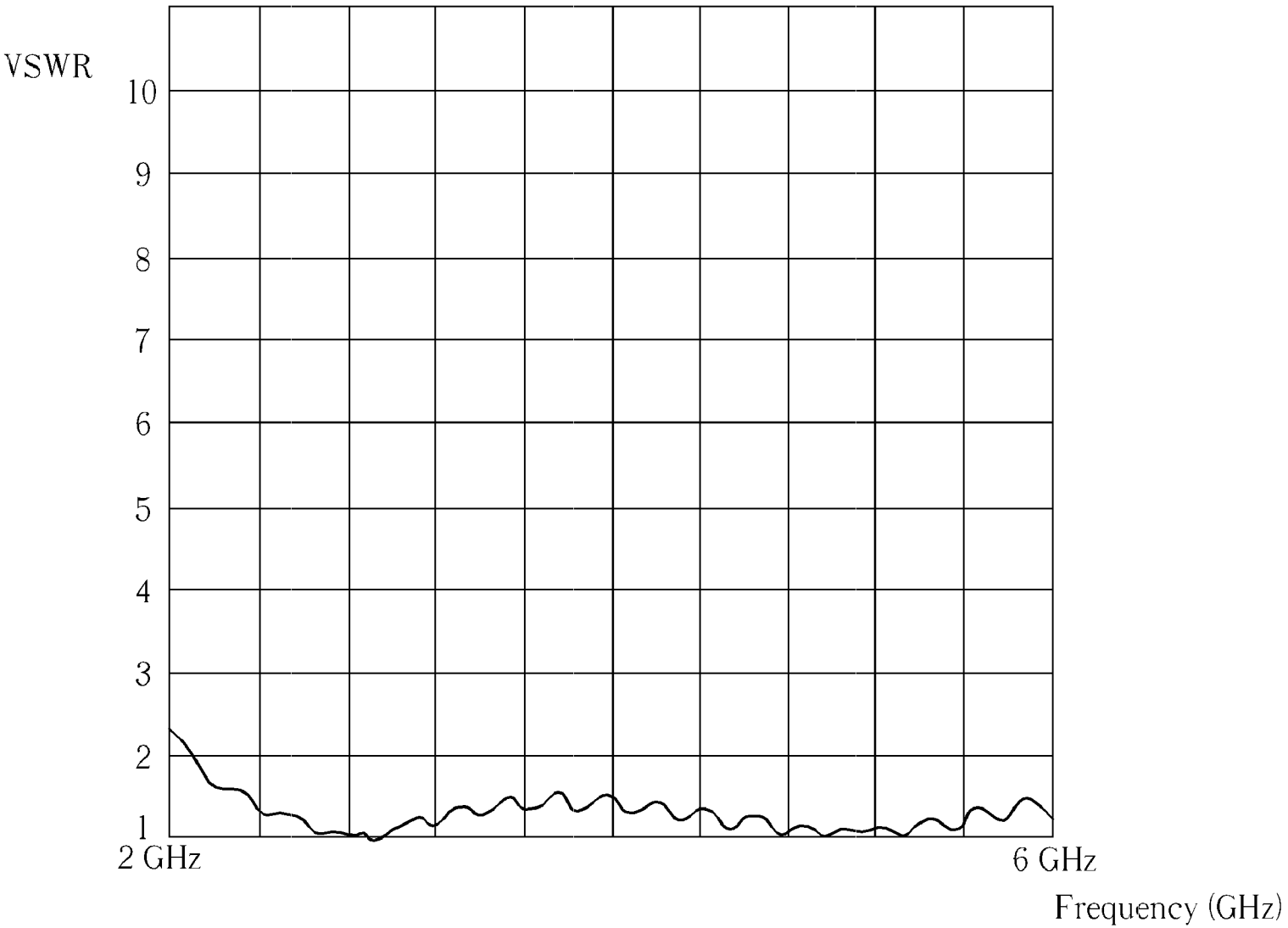
FIG. 14 is a diagram illustrating the VSWR of the wideband antenna in FIG. 13.

Please refer to FIG. 14 and FIG. 13. FIG. 14 is a diagram illustrating the VSWR of the wideband antenna 60 in FIG. 13. The horizontal axis represents frequency (GHz) that distributes from 2 GHz to 6 GHz, and the vertical axis represents VSWR. Due to the wideband antenna 60 being the changed form of the wideband antenna 10, the VSWR in FIG. 14 is different from the VSWR in FIG. 3 and in FIG. 4, and the different VSWRs can be applied according to different system demands.

Figure 15:
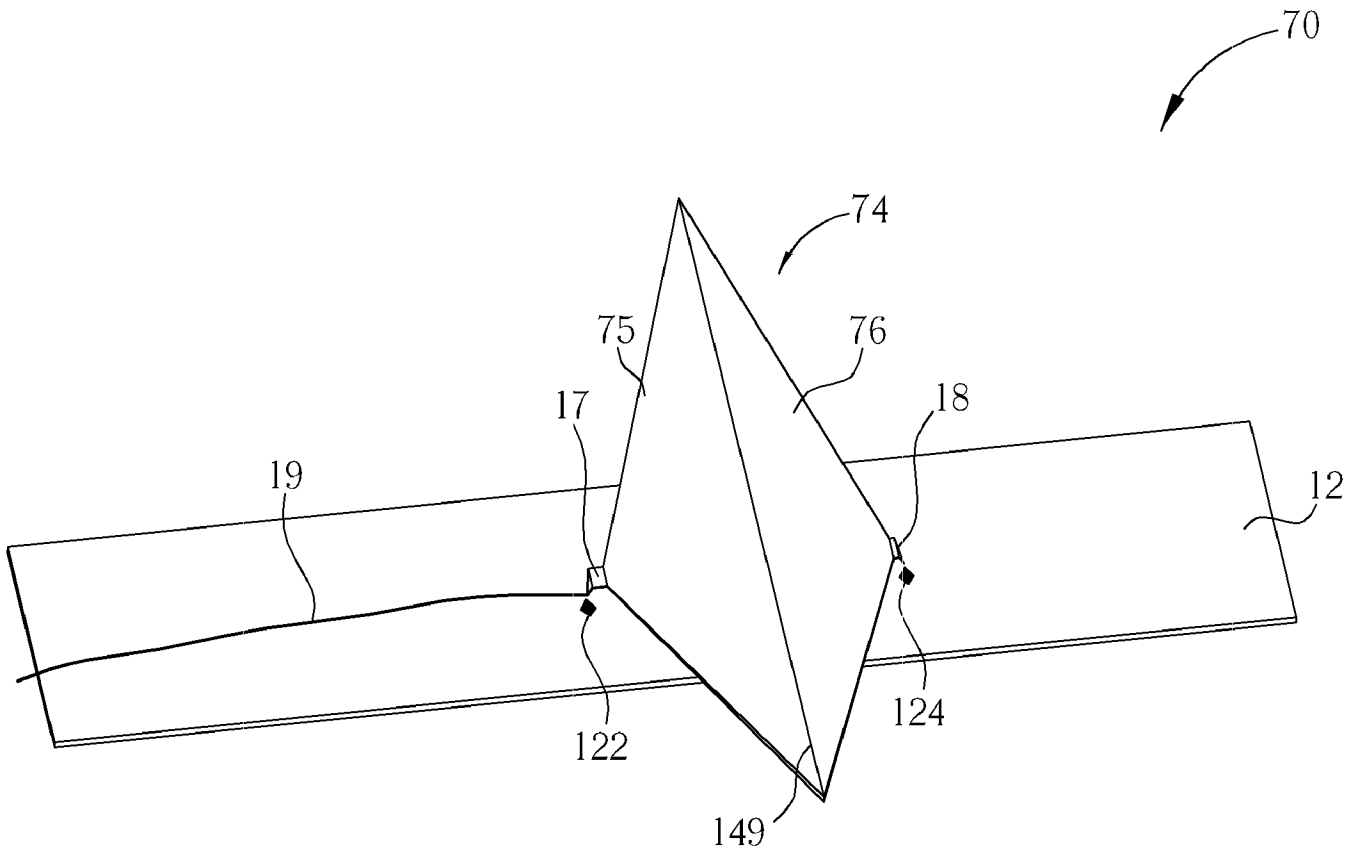
FIG. 15 is a diagram of a three-dimensional wideband antenna according to another embodiment of the present invention.

Please refer to FIG. 15, FIG. 1, and FIG. 2. FIG. 15 is a diagram of a three-dimensional wideband antenna 70 according to another embodiment of the present invention. A radiator 74 of the wideband antenna 70 includes a first child radiator 75 and a second child radiator 76, a difference between the wideband antenna 70 and the wideband antenna 10 in FIG. 1 being that the first child radiator 75 and the second child radiator 76 are formed by bending the rhombus metal sheet along another diagonal 149 of the rhombus metal sheet. At this time, the first interior angle $\phi_1$ is greater than 90 degrees and the second interior angle $\phi_2$ is smaller than 90 degrees. Please note that the embodiment is merely used for illustration, and the first interior angle $\phi_1$ and the second interior angle $\phi_2$ are not limited to fixed values.

Figure 16:
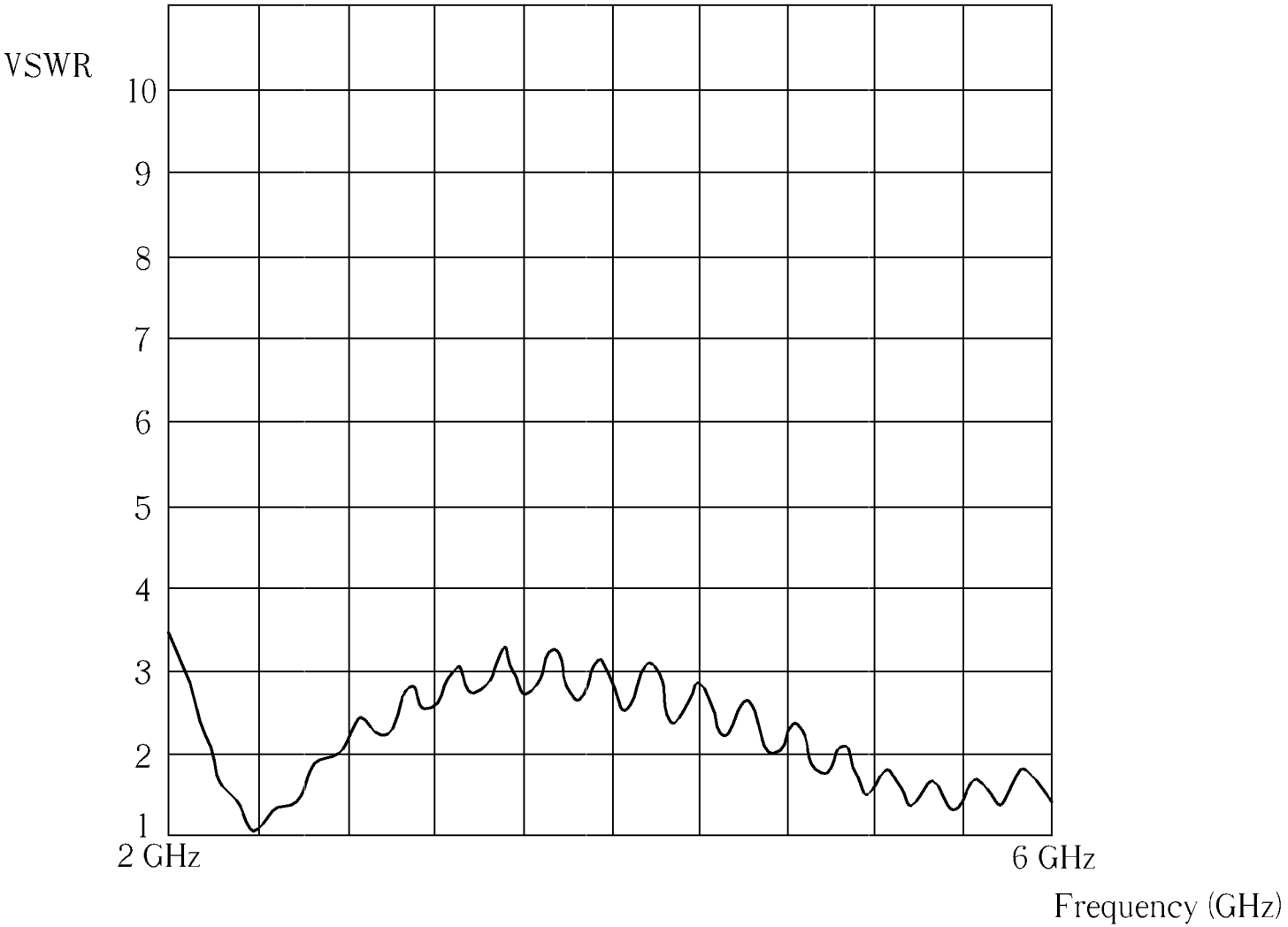
FIG. 16 is a diagram illustrating the VSWR of the wideband antenna in FIG. 15.

Please refer to FIG. 16 and FIG. 15. FIG. 16 is a diagram illustrating the VSWR of the wideband antenna 70 in FIG. 15. The horizontal axis represents frequency (GHz) that distributes from 2 GHz to 6 GHz, and the vertical axis represents VSWR. Due to the wideband antenna 70 being the changed form of the wideband antenna 10, the VSWR in FIG. 16 is different from the VSWR in FIG. 3 and in FIG. 4, and the different VSWRs can be applied according to different system demands.

Figure 17:
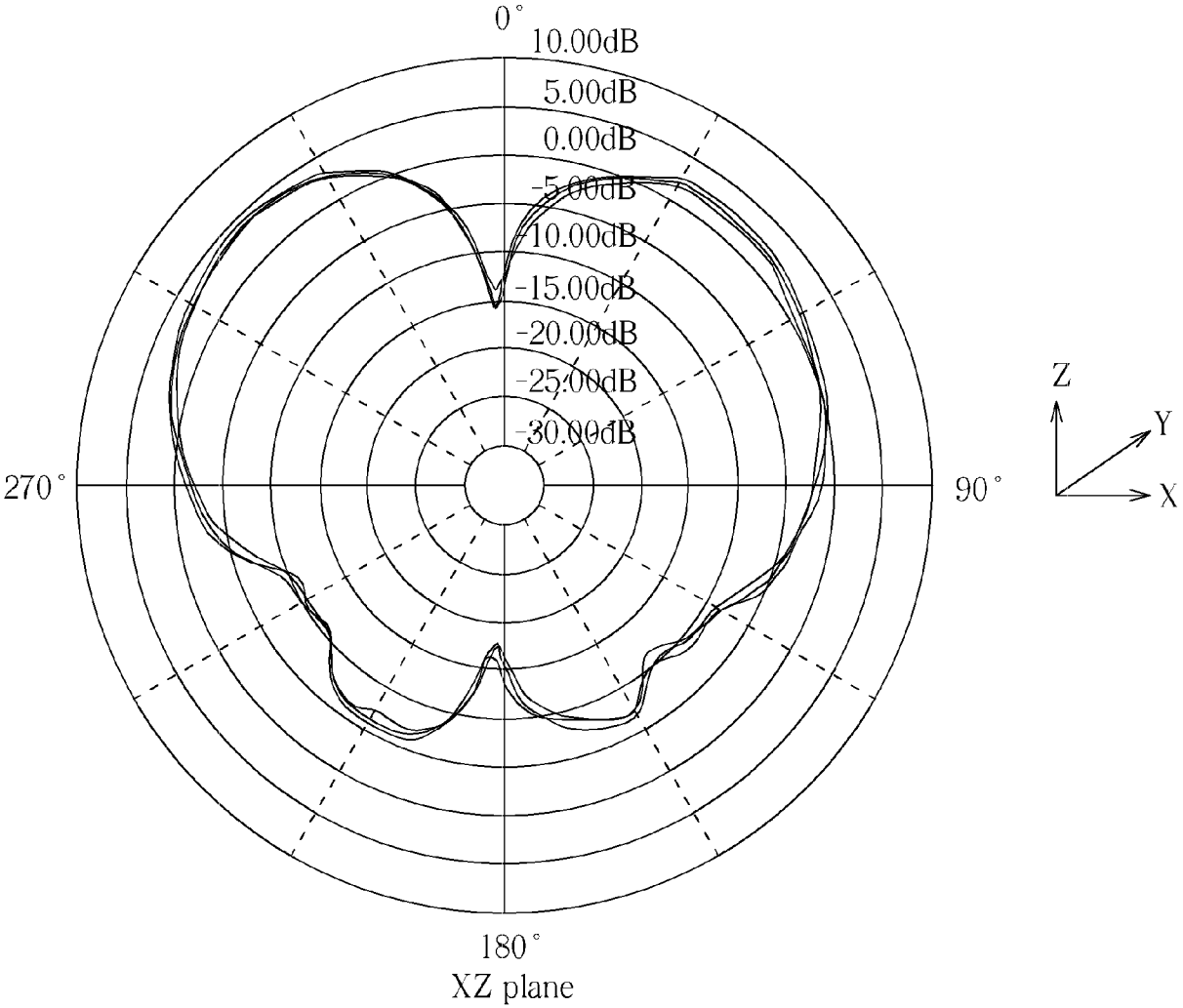
FIG. 17 is a diagram of a radiation pattern of the wideband antenna in FIG. 1.

Please refer to FIG. 17 and FIG. 18. FIG. 17 is a diagram of a radiation pattern of the wideband antenna 10 in FIG. 1. FIG. 17 represents measuring results of the wideband antenna 10 in the XZ plane, which has an operational frequency of 2 GHz. FIG. 18 is a diagram showing the positions and the values of the maximum values and the minimum values in FIG. 17. As shown in FIG. 17 and FIG. 18, the positions of the maximum values approximately fall in (−45°), having an approximate value range of 3.92 dB~4.31 dB. The positions of the minimum values approximately fall in (−175°), having a value of about (−17 dB). It can be seen from the measuring results that the wideband antenna 10 in (+60°~−60°) of the XZ plane forms a radiation pattern with higher radiation efficiency, which can satisfy operational demands of wireless LAN systems.

Figure 19:
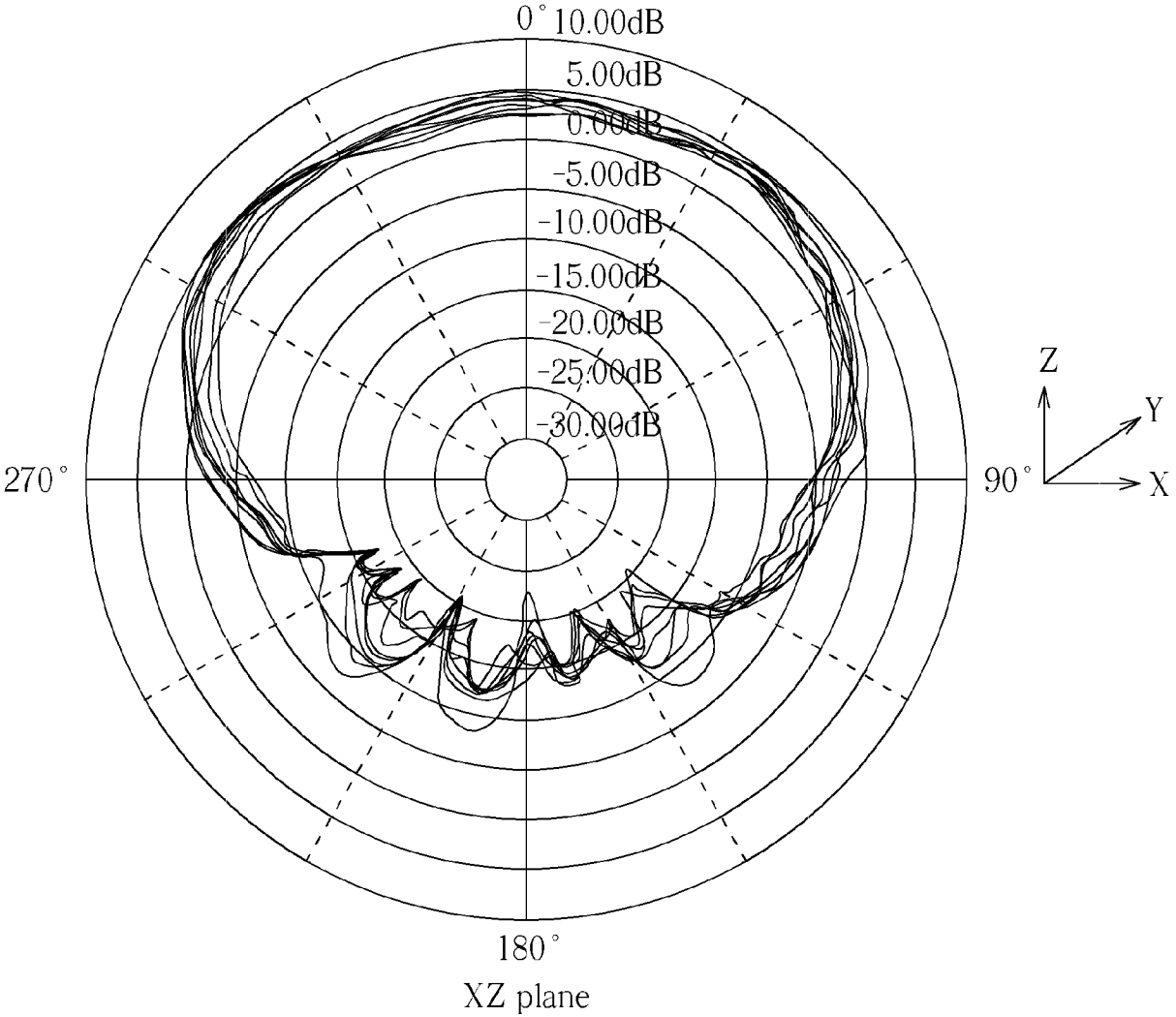
FIG. 19 is a diagram of a radiation pattern of the wideband antenna in FIG. 1.

Please refer to FIG. 19 and FIG. 20. FIG. 19 is a diagram of a radiation pattern of the wideband antenna 10 in FIG. 1. FIG. 19 represents measuring results of the wideband antenna 10 in the XZ plane, which has an operational frequency of 5 GHz. FIG. 20 is a diagram showing the positions and the values of the maximum values and the minimum values in FIG. 19. As shown in FIG. 19 and FIG. 20, the positions of the maximum values approximately fall in (−45°) and (3°), which have an approximate value range of about 4.45 dB~5.64 dB. The positions of the minimum values approximately fall in (−150°~−180°) and (132°~177°), which have a value of about (−20 dB). It can be seen from the measuring results that the wideband antenna 10 in (+60°~−60°) of the XZ plane forms a radiation pattern with higher radiation efficiency, which can satisfy operational demands of wireless LAN systems.

Thus it can be seen from the abovementioned embodiments that the operational frequency and the radiation patterns of the wideband antenna 10 can be adjusted by changing the first angle $\theta_1$ and the first height $h_1$. For example, the operational frequency and the radiation patterns of the wideband antenna 10 can be changed by adding bends, formed by changing the shape or the material of the second child radiator 16.

Figure 21:
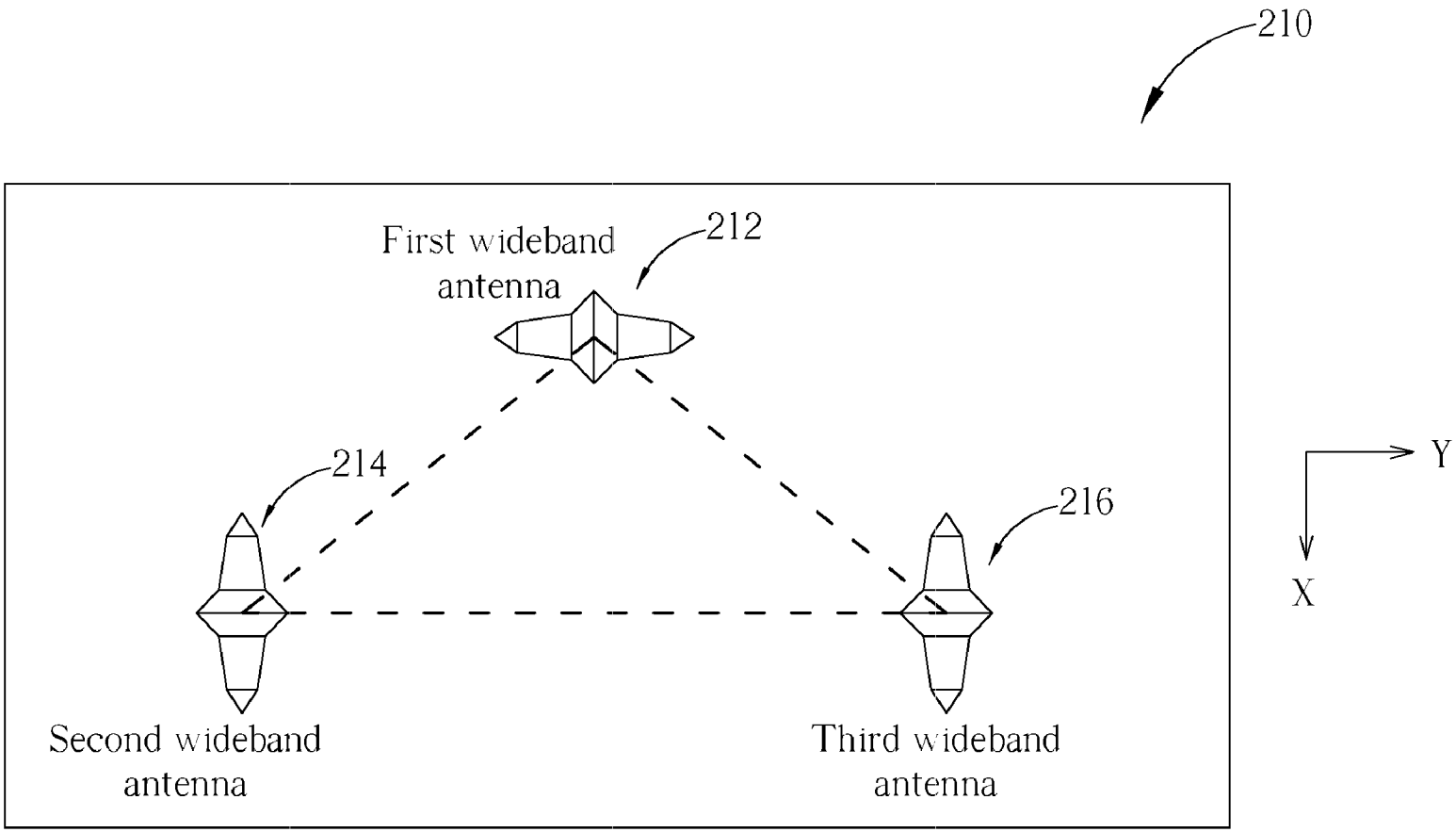
FIG. 21 is a diagram of a wireless communication device with three-dimensional wideband antennas according to an embodiment of the present invention.

Please refer to FIG. 21. FIG. 21 is a diagram of a wireless communication device 210 with three-dimensional wideband antennas according to an embodiment of the present invention. The wireless communication device 210 includes a system circuit (not shown in FIG. 21), a first wideband antenna 212, a second wideband antenna 214, and a third wideband antenna 216. The first wideband antenna 212, the second wideband antenna 214, and the third wideband antenna 216 are connected to the system circuit, and each wideband antenna is the abovementioned wideband antenna 10 or one of the changed forms. An arrangement manner of the first wideband antenna 212, the second wideband antenna 214, and the third wideband antenna 216 located inside the wireless communication device 210 is a connection line of three center points of the three wideband antennas forming a triangle. The wireless communication device 210 is a wireless access point (WAP).

Figure 22:
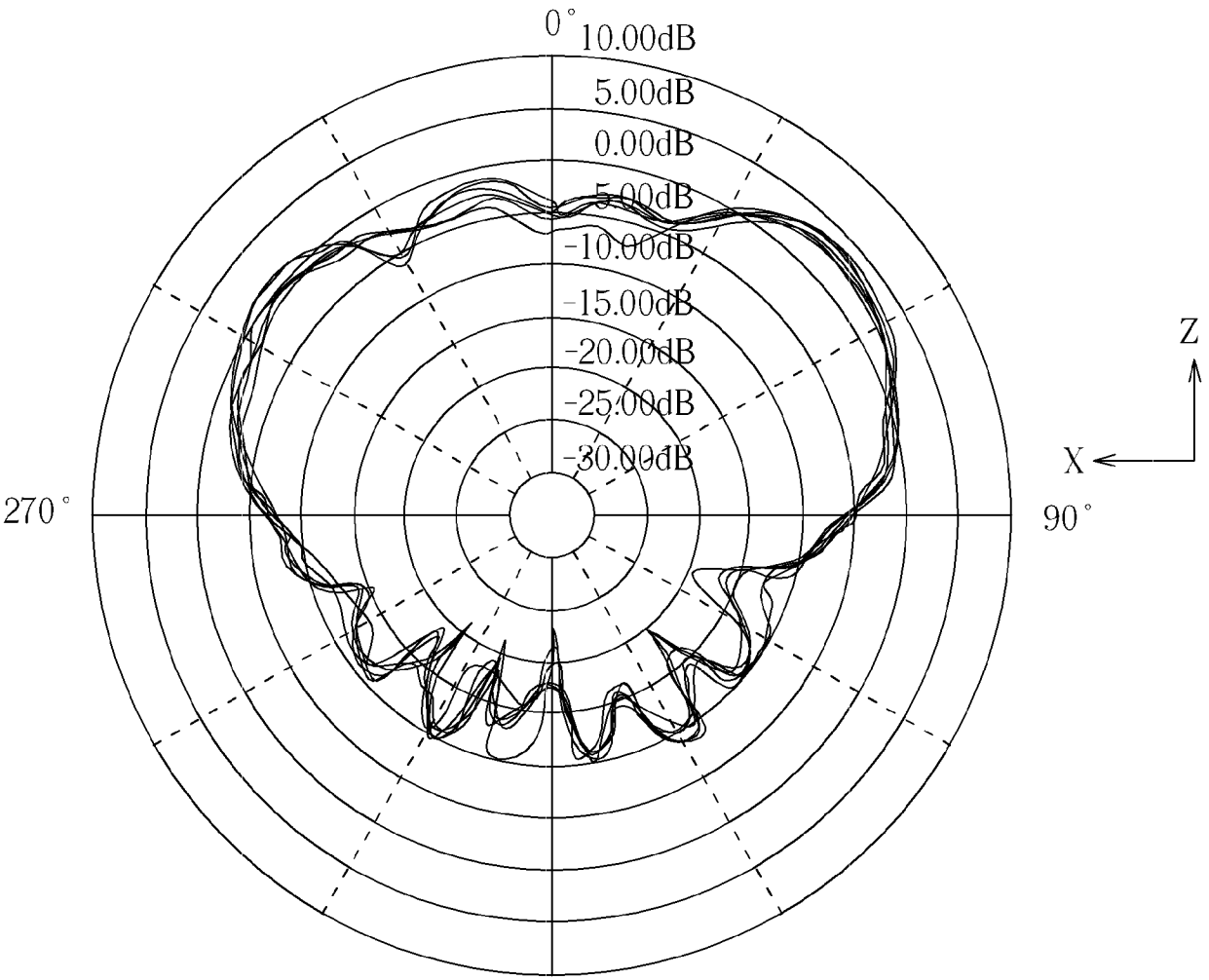
FIG. 22 is a diagram of a radiation pattern of the first wideband antenna in FIG. 21.
Figure 23:
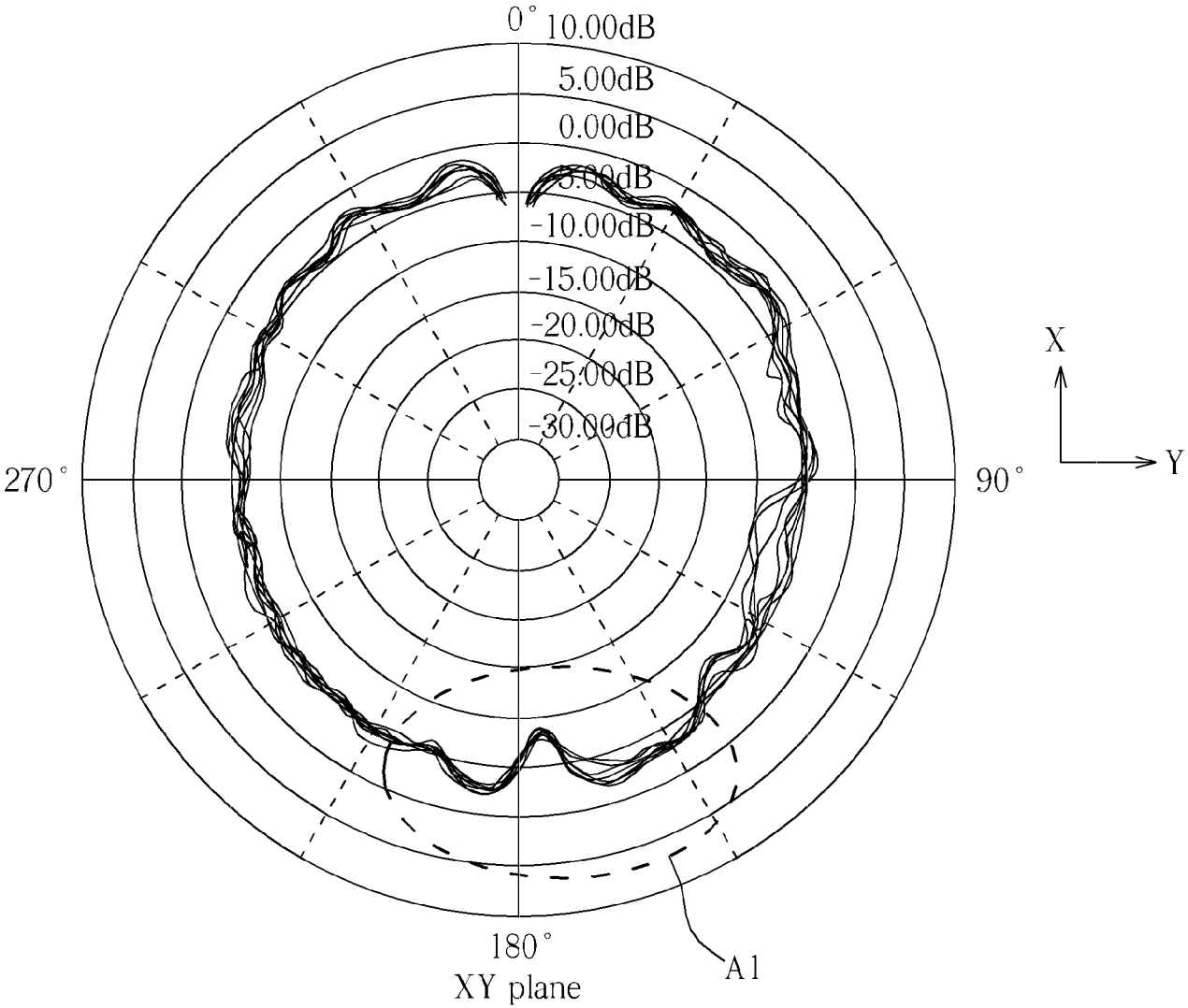
FIG. 23 is a diagram of a radiation pattern of the first wideband antenna in FIG. 21.

Please refer to FIG. 22 and FIG. 23. FIG. 22 and FIG. 23 are both diagrams of a radiation pattern of the first wideband antenna 212 in FIG. 21. FIG. 22 represents measuring results of the first wideband antenna 212 in the ZX plane, and FIG. 23 represents measuring results of the first wideband antenna 212 in the XY plane. Thus it can be seen from the measuring results that the cover range of the radiation pattern in the ZX plane is very large, with most falling between (−75°) and (75°). Furthermore, the characteristic of the radiation pattern in the XY plane is that it has a small hollow, as marked in a portion A1.

Figure 24:
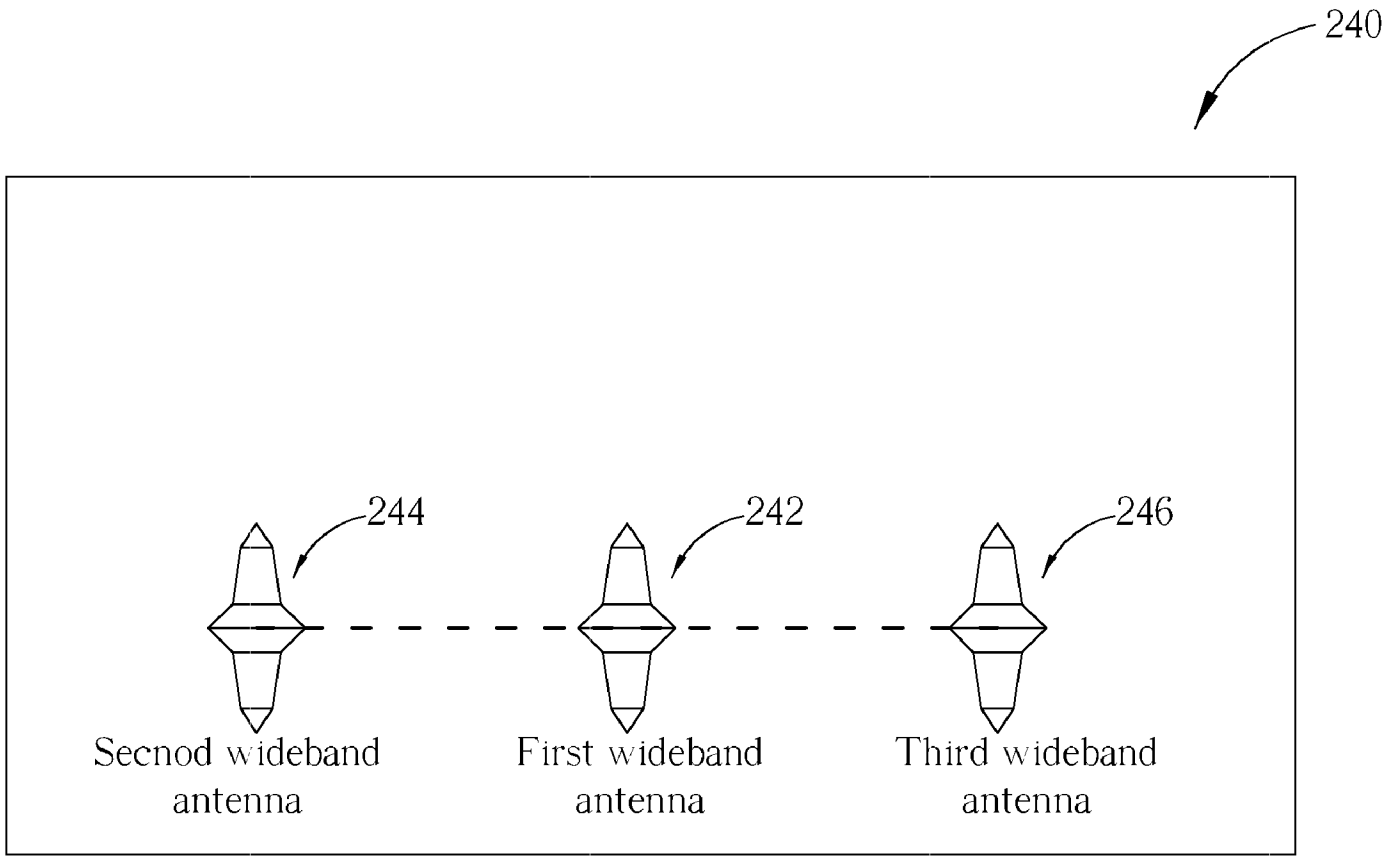
FIG. 24 is a diagram of a wireless communication device with three-dimensional wideband antennas according to an embodiment of the present invention.

Please refer to FIG. 24. FIG. 24 is a diagram of a wireless communication device 240 with three-dimensional wideband antennas according to an embodiment of the present invention. The wireless communication device 240 includes a system circuit (not shown in FIG. 24), a first wideband antenna 242, a second wideband antenna 244, and a third wideband antenna 246. The first wideband antenna 242, the second wideband antenna 244, and the third wideband antenna 246 are connected to the system circuit, and each wideband antenna is the abovementioned wideband antenna 10 or one of the changed forms. Please note that a difference between the wireless communication device 240 and the wireless communication device 210 is that an arrangement manner of the first wideband antenna 242, the second wideband antenna 244, and the third wideband antenna 246 located inside the wireless communication device 240 is a connection line of three center points of the three wideband antennas forming a straight line. The wireless communication device 240 is a wireless access point (WAP).

Figure 25:
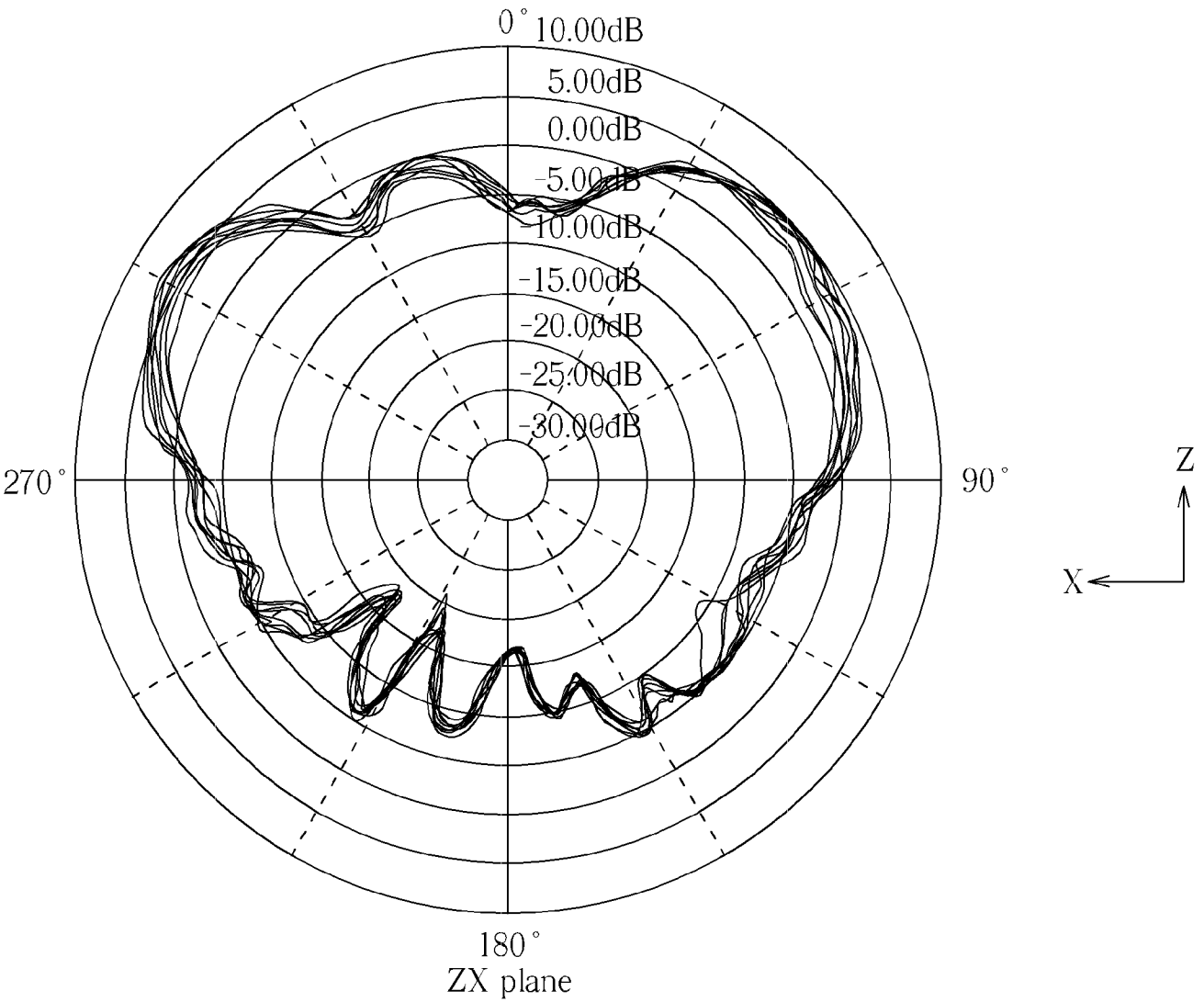
FIG. 25 is a diagram of a radiation pattern of the first wideband antenna in FIG. 24.
Figure 26:
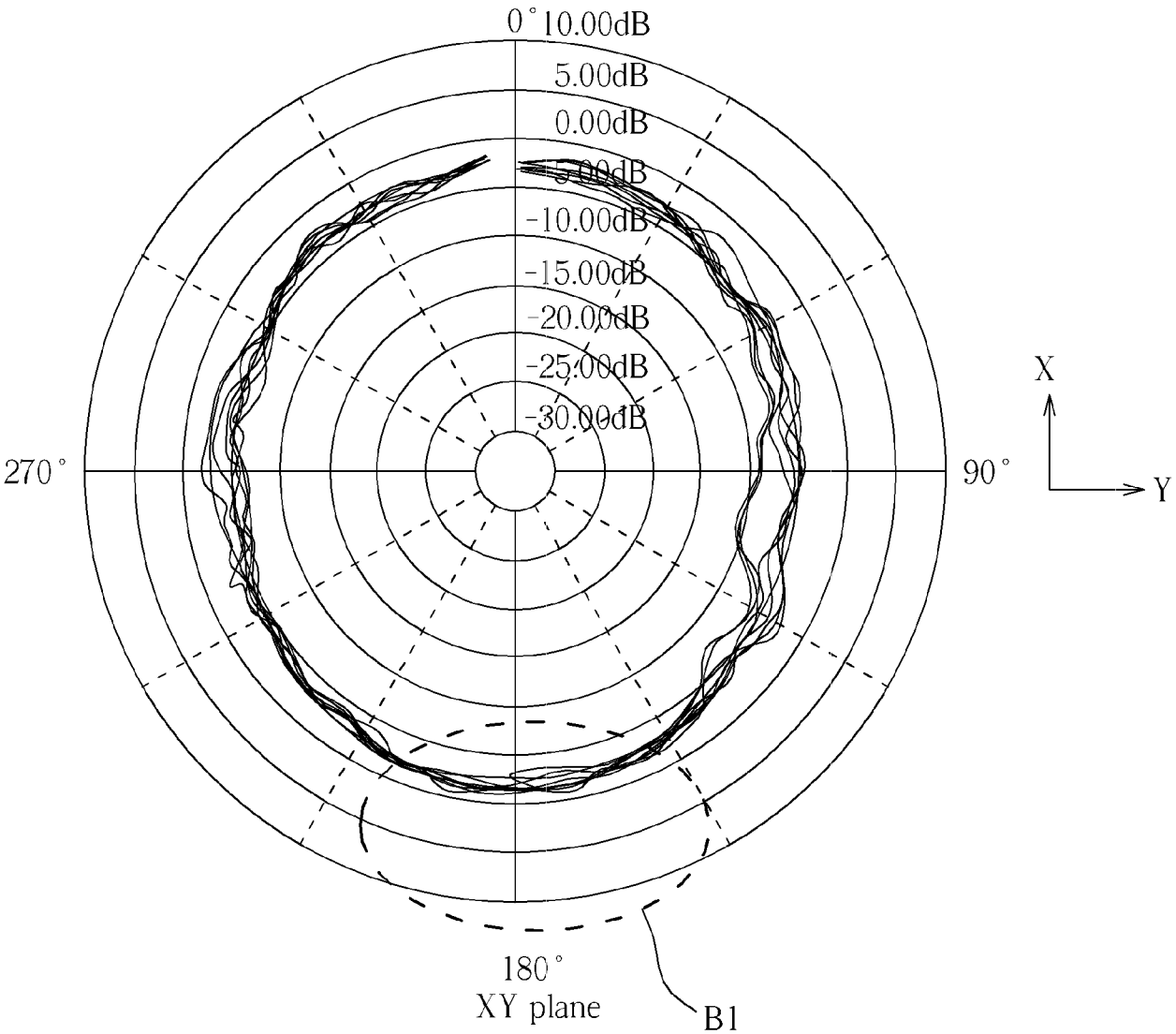
FIG. 26 is a diagram of a radiation pattern of the first wideband antenna in FIG. 24.

Please refer to FIG. 25 and FIG. 26. FIG. 25 and FIG. 26 are both diagrams of a radiation pattern of the first wideband antenna 242 in FIG. 24. FIG. 25 represents measuring results of the first wideband antenna 242 in the ZX plane, and FIG. 26 represents measuring results of the first wideband antenna 242 in the XY plane. Thus it can be seen from the measuring results that the cover range of the radiation pattern in the ZX plane is very large, with most falling between (−75°) and (75°). Furthermore, the characteristic of the radiation pattern in the XY plane is that it has no small hollow, as marked in a portion B1. The small hollow of the first wideband antenna 242 in the radiation pattern in the XY plane disappears due to compression effects caused by the second wideband antenna 244 and the third wideband antenna 246.

The abovementioned embodiments are presented merely to describe the present invention, and in no way should be considered to be limitations of the scope of the present invention. The abovementioned wideband antenna 10 may include several changed forms, for example, the wideband antennas 20, 30, and 40 are generated by adding a certain amount of bends of the first child radiator 15 and the second child radiator 16, the wideband antenna 50 is generated by changing the shape of the second child radiator 56, and the wideband antenna 60 is generated by changing the material of the second child radiator 66. Therefore, the operational frequency and the radiation patterns of the wideband antenna 10 will be changed. However, the wideband antennas 10~70 are merely used for illustration and should not be restricted. Furthermore, the operational frequency and the radiation patterns of the wideband antenna 10 can be adjusted by changing the first angle $\theta_1$, the first height $h_1$, and the second height $h_2$. The first angle $\theta_1$, the first height $h_1$, the second height $h_2$, the first length $L_1$, the first interior angle $\phi_1$, and the second interior angle $\phi_2$ are not limited to fixed values only and can be adjusted depending on user's demands. The amount of the antennas installed in the wireless communication device 210 and the wireless communication device 240 is not limited to be three only and can be other amounts.

Figure 27:
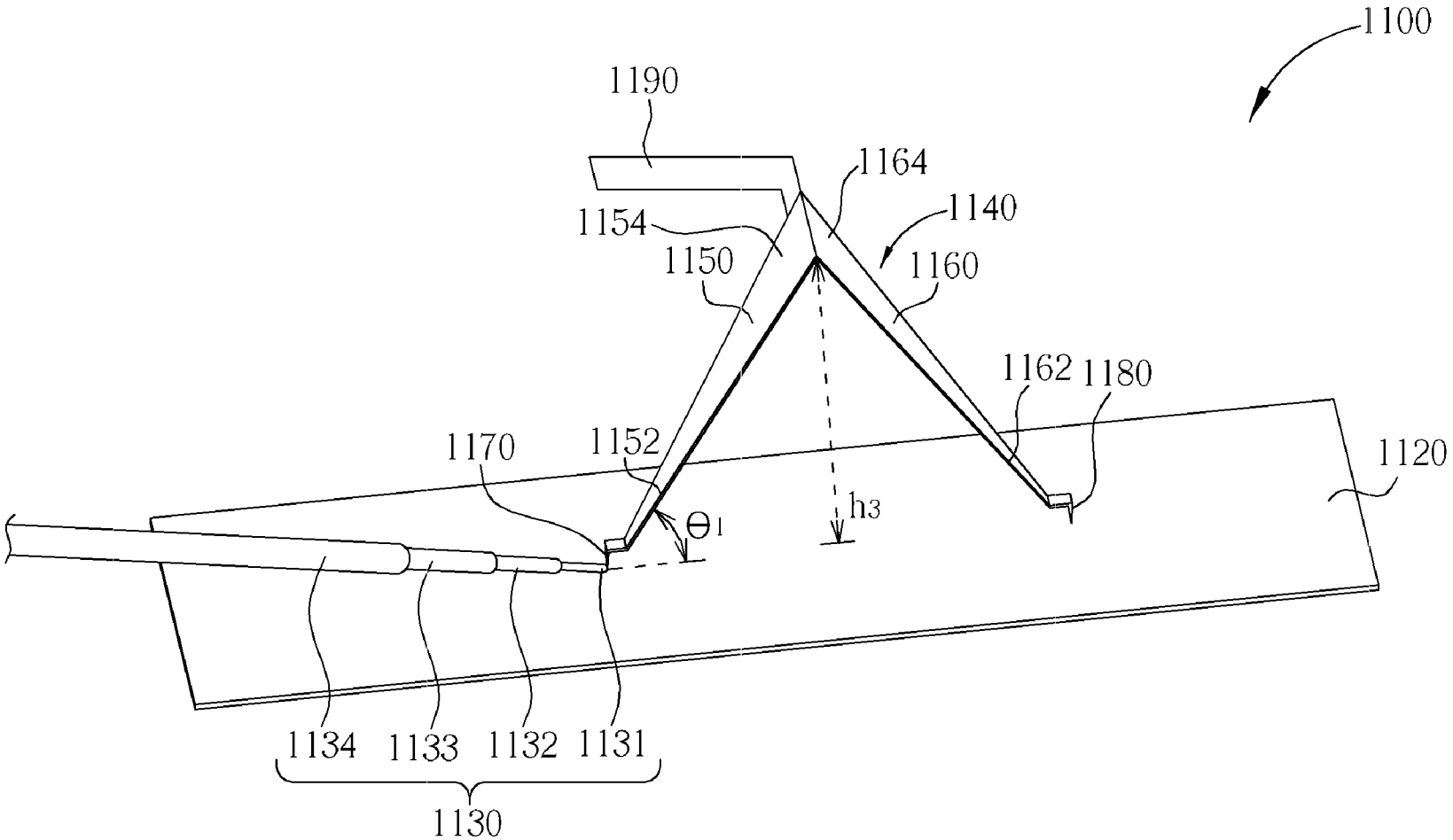
FIG. 27 is a diagram of a three-dimensional antenna according to an embodiment of the present invention.

Please refer to FIG. 27. FIG. 27 is a diagram of a three-dimensional antenna 1100 according to an embodiment of the present invention. As shown in FIG. 27, the three-dimensional antenna 1100 includes a substrate 1120, a radiator 1140, a second radiator 1190, a signal feeding element 1170, and a grounding element 1180. The radiator 1140 is installed on the substrate 1120. The radiator 1140 includes a first child radiator 1150 and a second child radiator 1160. The first child radiator 1150 has a first end 1152 and a second end 1154. The second child radiator 1160 has a first end 1162 and a second end 1164, wherein the second end 1164 of the second child radiator 1160 is coupled to the second end 1154 of the first child radiator 1150. The second radiator 1190 is coupled to the radiator 1140 for adjusting operational frequencies and radiation patterns of the three-dimensional antenna 1100. The signal feeding element 1170 is coupled to the first end 1152 of the first child radiator 1150. The grounding element 1180 is coupled between the substrate 1120 and the first end 1162 of the second child radiator 1160. The first child radiator 1150 and the second child radiator 1160 form an inverted V-shape installed on the substrate 1120.

Besides, the signal feeding element 1170 is further connected to a coaxial cable 1130 having a first conductor layer 1131, a first isolation layer 1132, a second conductor layer 1133, and a second isolation layer 1134, wherein the first isolation layer 1132 covers the first conductor layer 1131 and lies in between the first conductor layer 1131 and the second conductor layer 1133, the second isolation layer 1134 covers the second conductor layer 1133. The first conductor layer 1131 is coupled to the signal feeding element 1170, and the second conductor layer 1133 is coupled to the substrate 1120 of the three-dimensional antenna 1100. The substrate 1120 includes dielectric material and is connected to a system ground terminal electrically. Preferably, the substrate 1120 is a thin metal plane. The three-dimensional antenna 1100 is installed inside a wireless communication device, such as a wireless access point (WAP).

Figure 28:
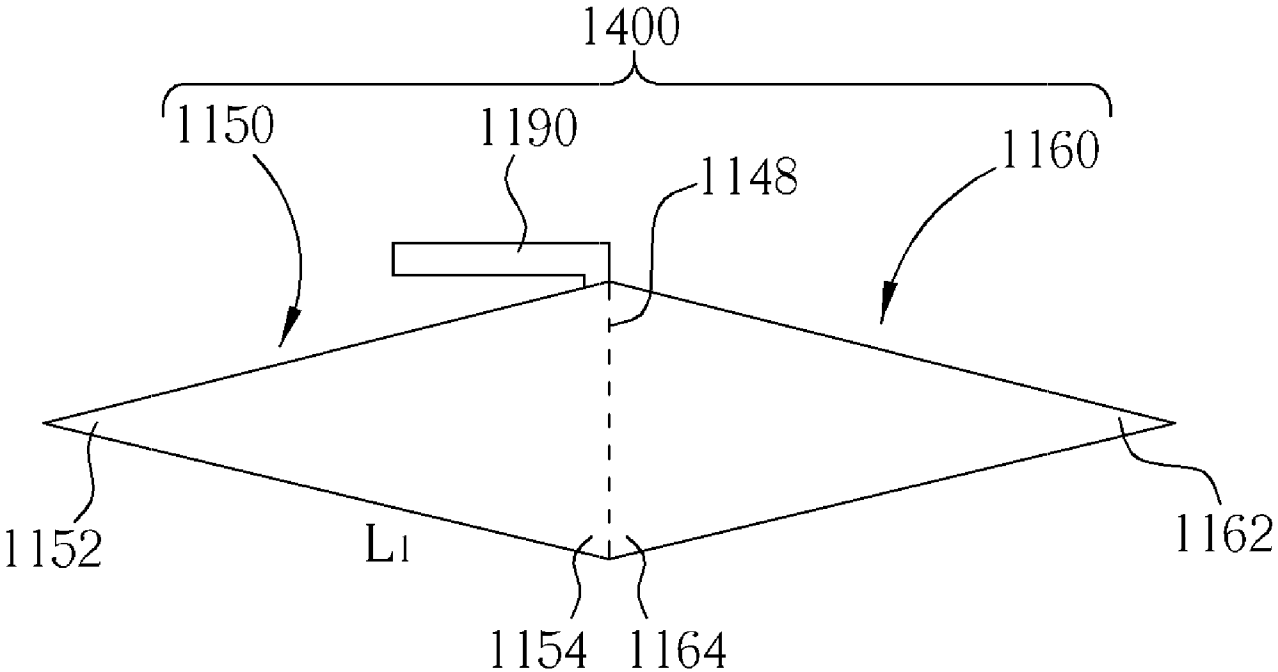
FIG. 28 is a diagram illustrating the radiator and the second radiator of the three-dimensional antenna shown in FIG. 27.

Please refer to FIG. 28 and FIG. 27. FIG. 28 is a diagram illustrating the radiator 1140 and the second radiator 1190 of the three-dimensional antenna 1100 in FIG. 27. The first child radiator 1150, the second child radiator 1160, and the second radiator 1190 are substantially composed of a single metal sheet. The first child radiator 1150 and the second child radiator 1160 are formed by bending the metal sheet along a diagonal 1148 of the metal sheet. In this embodiment, the second radiator 1190 is coupled to the second end 1154 of the first child radiator 1150. The second radiator 1190 and the second child radiator 1160 extend to in opposite directions. In addition, the second radiator 1190 is approximately a rectangle. Please note that this embodiment is merely used for illustration, and the shape of the second radiator 1190 can be other shapes and is not limited to the rectangle. Furthermore, the extending direction of the second radiator 1190 and its connecting position are not limited.

The three-dimensional antenna 1100 shown in FIG. 27 is merely an embodiment of the present invention, and, as is well known by a person of ordinary skill in the art, suitable variations can be applied to the three-dimensional antenna 1100.

Figure 29:
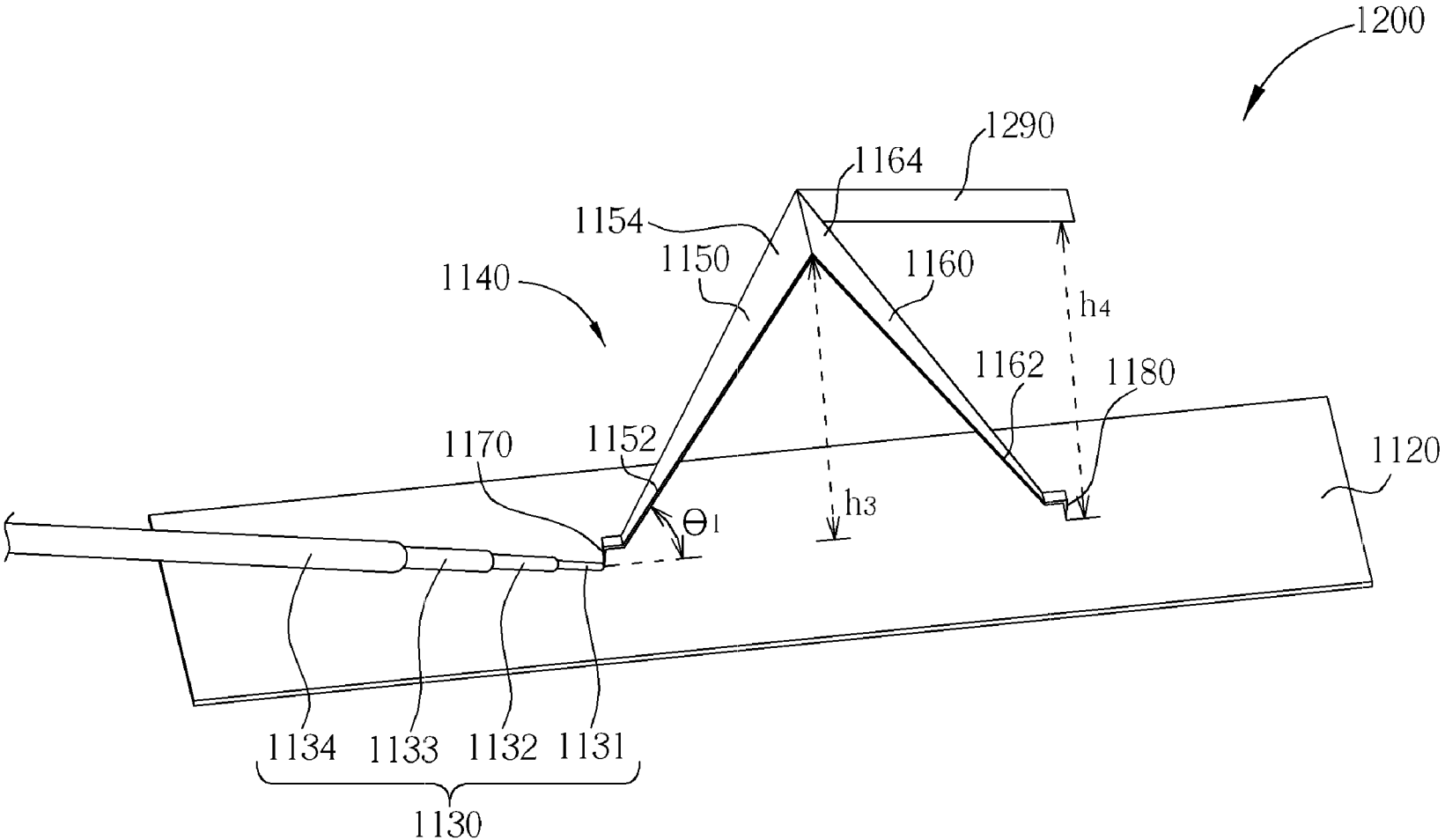
FIG. 29 is a diagram of a three-dimensional antenna according to another embodiment of the present invention.

Please refer to FIG. 29. FIG. 29 is a diagram of a three-dimensional antenna 1200 according to another embodiment of the present invention, which is a changed form of the three-dimensional antenna 1100 shown in FIG. 27. The architecture of the three-dimensional antenna 1200 in FIG. 29 is similar to the three-dimensional antenna 1100 in FIG. 27. The difference between them is that the second radiator 1290 of the three-dimensional antenna 1200 is coupled to the second end 1164 of the second child radiator 1160, and the second radiator 1290 and the first child radiator 1150 extend to in opposite directions.

Please note that, in this embodiment, the second radiator 1290 is approximately parallel to the substrate 1120. In other words, a distance $h_3$ between the second end 1164 of the second child radiator 1160 and the substrate 1120 is substantially equal to a distance $h_4$ between the second radiator 1290 and the substrate 1120. But this should not be considered to be limitations of the present invention. In other embodiments, the distance $h_3$ can be slightly smaller than or greater than the distance $h_4$, which should also belong to the scope of the present invention.

Figure 30:
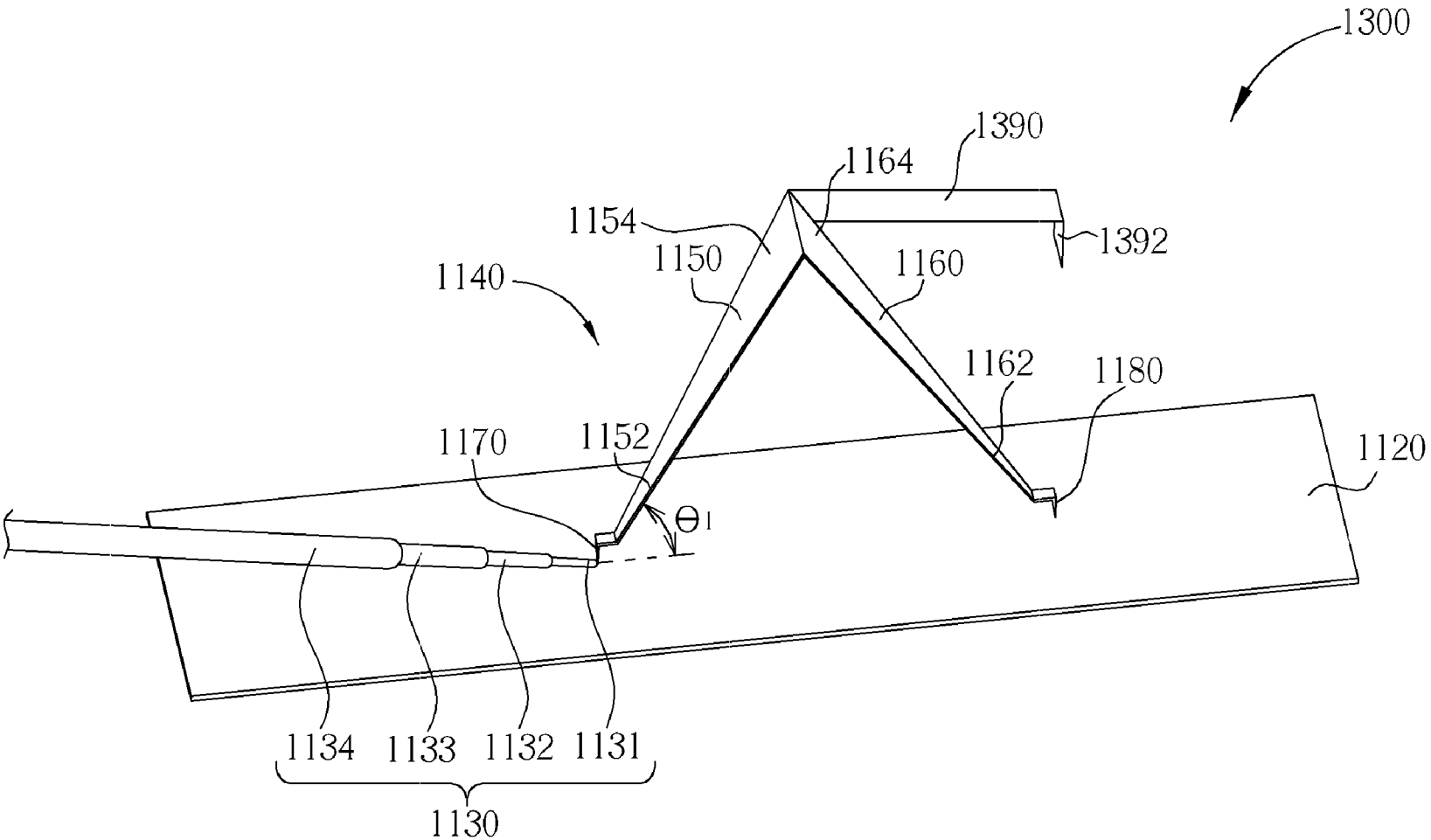
FIG. 30 is a diagram of a three-dimensional antenna according to another embodiment of the present invention.

Please refer to FIG. 30. FIG. 30 is a diagram of a three-dimensional antenna 1300 according to another embodiment of the present invention, which is a changed form of the three-dimensional antenna 1100 shown in FIG. 29. The architecture of the three-dimensional antenna 1300 in FIG. 30 is similar to the three-dimensional antenna 1200 in FIG. 29. The difference between them is that a second radiator 1390 of the three-dimensional antenna 1300 further includes at least one bend 1392. It should be noted that the number of the bends in the second radiator 1390 is not limited.

Figure 31:
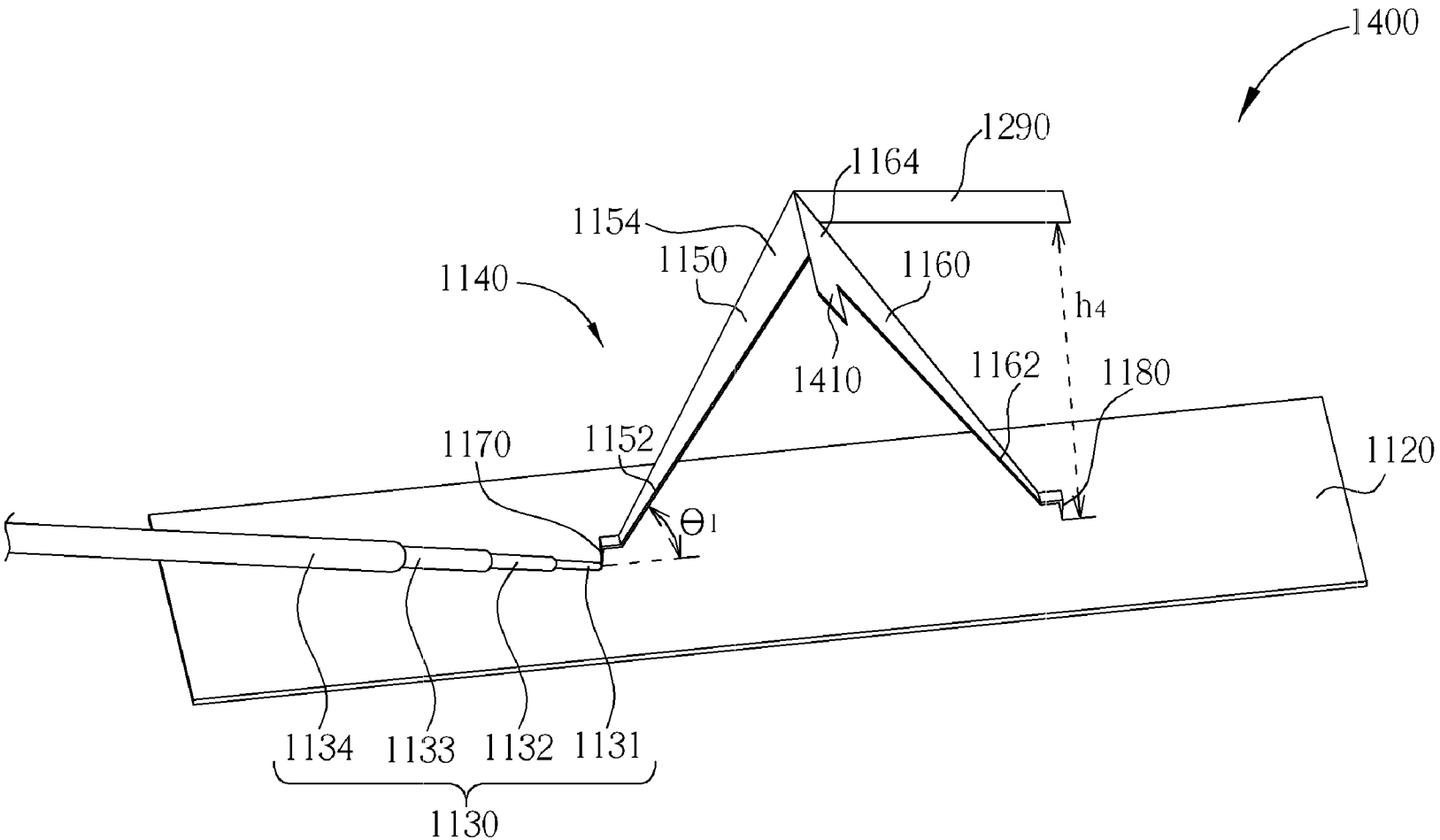
FIG. 31 is a diagram of a three-dimensional antenna according to another embodiment of the present invention.

Please refer to FIG. 31. FIG. 31 is a diagram of a three-dimensional antenna 1400 according to another embodiment of the present invention, which is a changed form of the three-dimensional antenna 1200 shown in FIG. 29. The architecture of the three-dimensional antenna 1400 in FIG. 31 is similar to the three-dimensional antenna 1200 in FIG. 29. The difference between them is that the three-dimensional antenna 1400 further includes a match element 1410 coupled to the second end 1154 of the first child radiator 1150 and the second end 1164 of the second child radiator 1160 for matching the impedance of the three-dimensional antenna 1400. In this embodiment, the first child radiator 1150, the second child radiator 1160, the second radiator 1290, and the match element 1410 are substantially composed of a single metal sheet. In addition, the match element 1410 is approximately a rectangle, but this should not be a limitation of the present invention. The shape of the match element 1410 is not limited to the rectangle and can be other shapes.

The abovementioned embodiments are presented merely to illustrate practicable designs of the present invention, and in no way should be considered to be limitations of the scope of the present invention. Those skilled in the art should appreciate that various modifications of the antennas shown in FIG. 1-FIG. 31 may be made without departing from the spirit of the present invention. For example, the antennas shown in FIG. 1-FIG. 31 can be arranged or combined randomly into a new varied embodiment.

Figure 32:
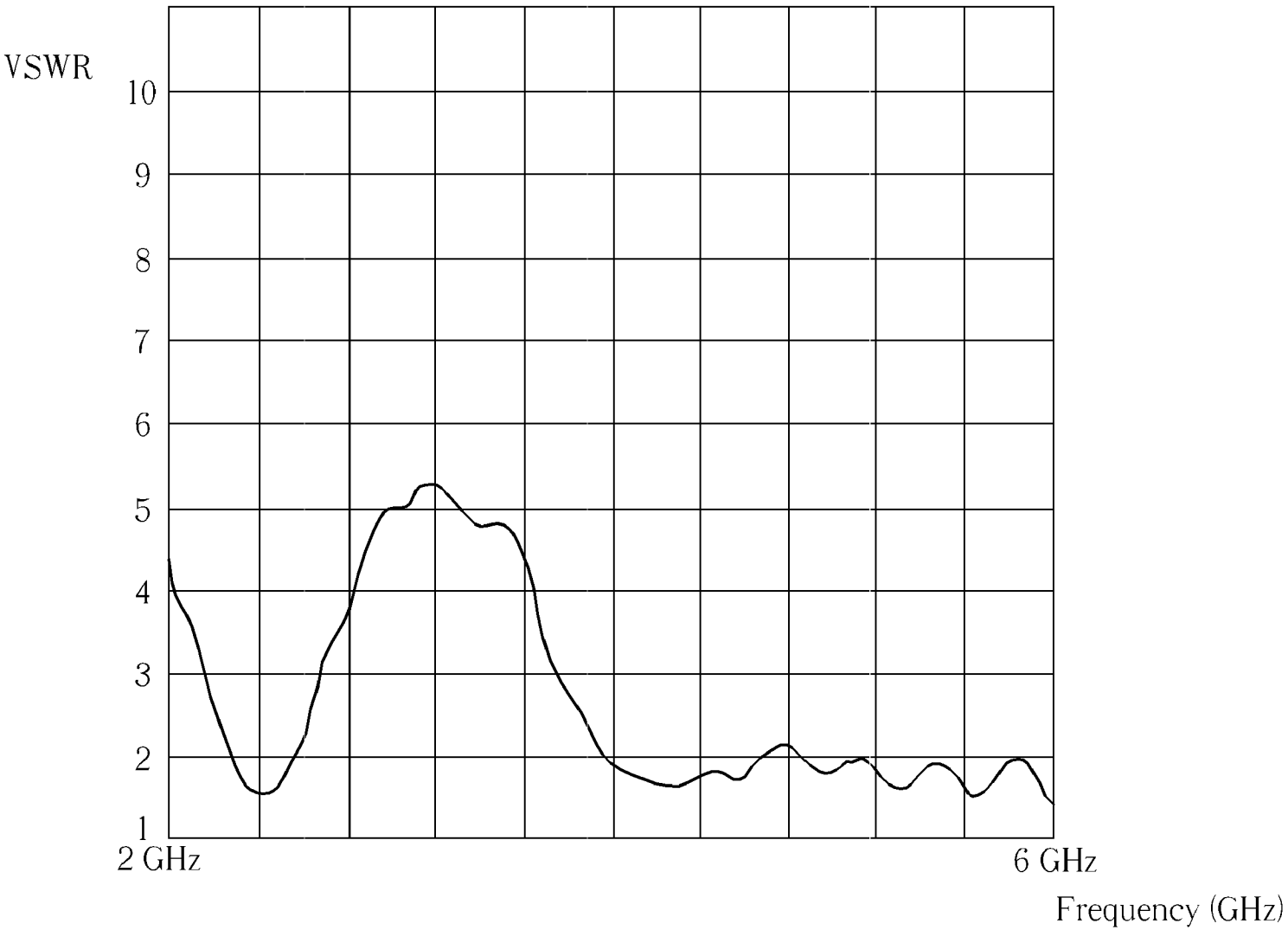
FIG. 32 is a diagram illustrating the VSWR of the three-dimensional antenna in FIG. 31.

Please refer to FIG. 32. FIG. 32 is a diagram illustrating the VSWR of the three-dimensional antenna 1400 in FIG. 31. The horizontal axis represents frequency (GHz) that distributes from 2 GHz to 6 GHz, and the vertical axis represents VSWR. As can be seen from FIG. 32, the operational frequencies of the three-dimensional antenna 1400 can be adjusted by the second radiator 1290 and the match element 1410.

Figure 33:
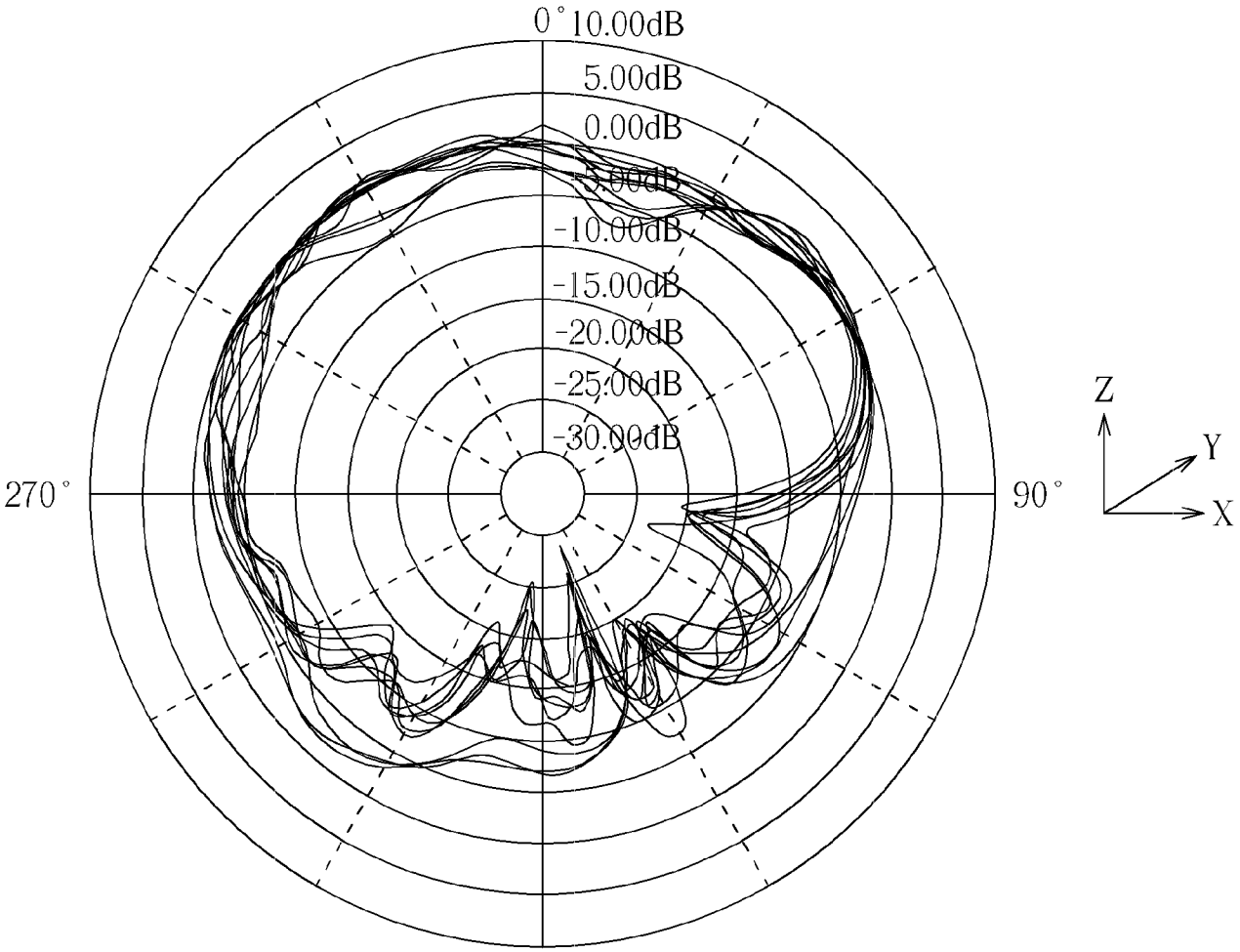
FIG. 33 is a diagram of a radiation pattern of the three-dimensional antenna in FIG. 31.

Please refer to FIG. 33 and FIG. 34. FIG. 33 represents measuring results of the three-dimensional antenna 1400 in the XZ plane, which has operational frequencies of 2.4 GHz and 5 GHz. FIG. 34 is a diagram showing the positions and the values of the maximum values and the minimum values in FIG. 33. As shown in FIG. 33 and FIG. 34, the positions of the maximum values approximately fall in (45°~51°) and (−30°~0°), which have an approximate value range of about 0.28 dB~1.71 dB. The positions of the minimum values approximately fall in (148°~165°) and (−168°), which have a value of about (−28 dB~−18 dB). It can be seen from the measuring results that the three-dimensional antenna 1400 in (+75°~−75°) of the XZ plane forms a radiation pattern with higher radiation efficiency, which can satisfy operational demands of wireless LAN systems.

Figure 35:
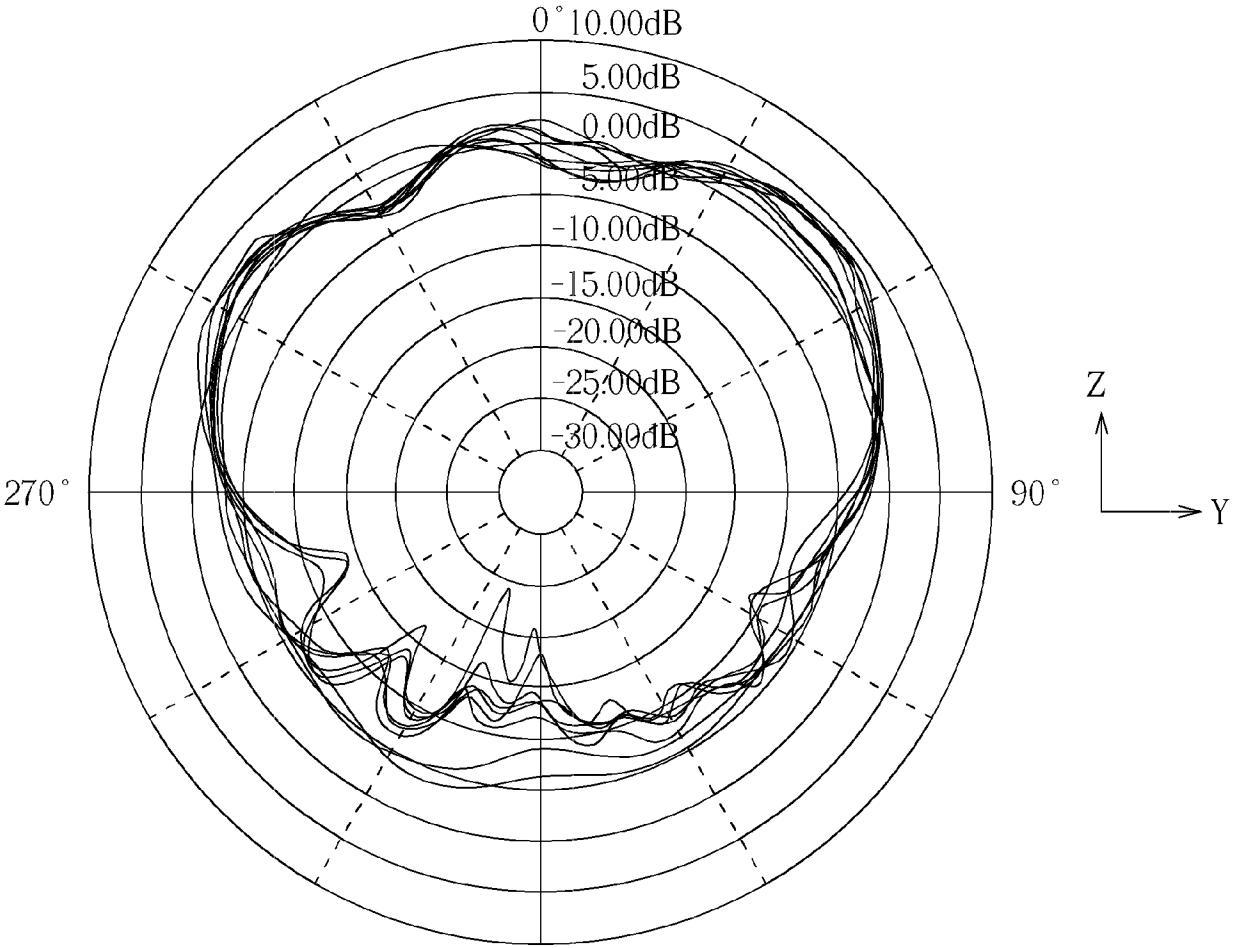
FIG. 35 is a diagram of another radiation pattern of the three-dimensional antenna in FIG. 31.

Please refer to FIG. 35 and FIG. 36. FIG. 35 represents measuring results of the three-dimensional antenna 1400 in the YZ plane, which has operational frequencies of 2.4 GHz and 5 GHz. FIG. 36 is a diagram showing the positions and the values of the maximum values and the minimum values in FIG. 35. As shown in FIG. 35 and FIG. 36, the positions of the maximum values approximately fall in (−31°~−28°) and (42°~54°), which have an approximate value range of about 1.5 dB~4 dB. The positions of the minimum values approximately fall in 177° and (−180°~−160°), which have a value of about (−23 dB~−6 dB). It can be seen from the measuring results that the three-dimensional antenna 1400 in (+75°~−75°) of the YZ plane forms a radiation pattern with higher radiation efficiency, which can satisfy operational demands of wireless LAN systems.

Figure 37:
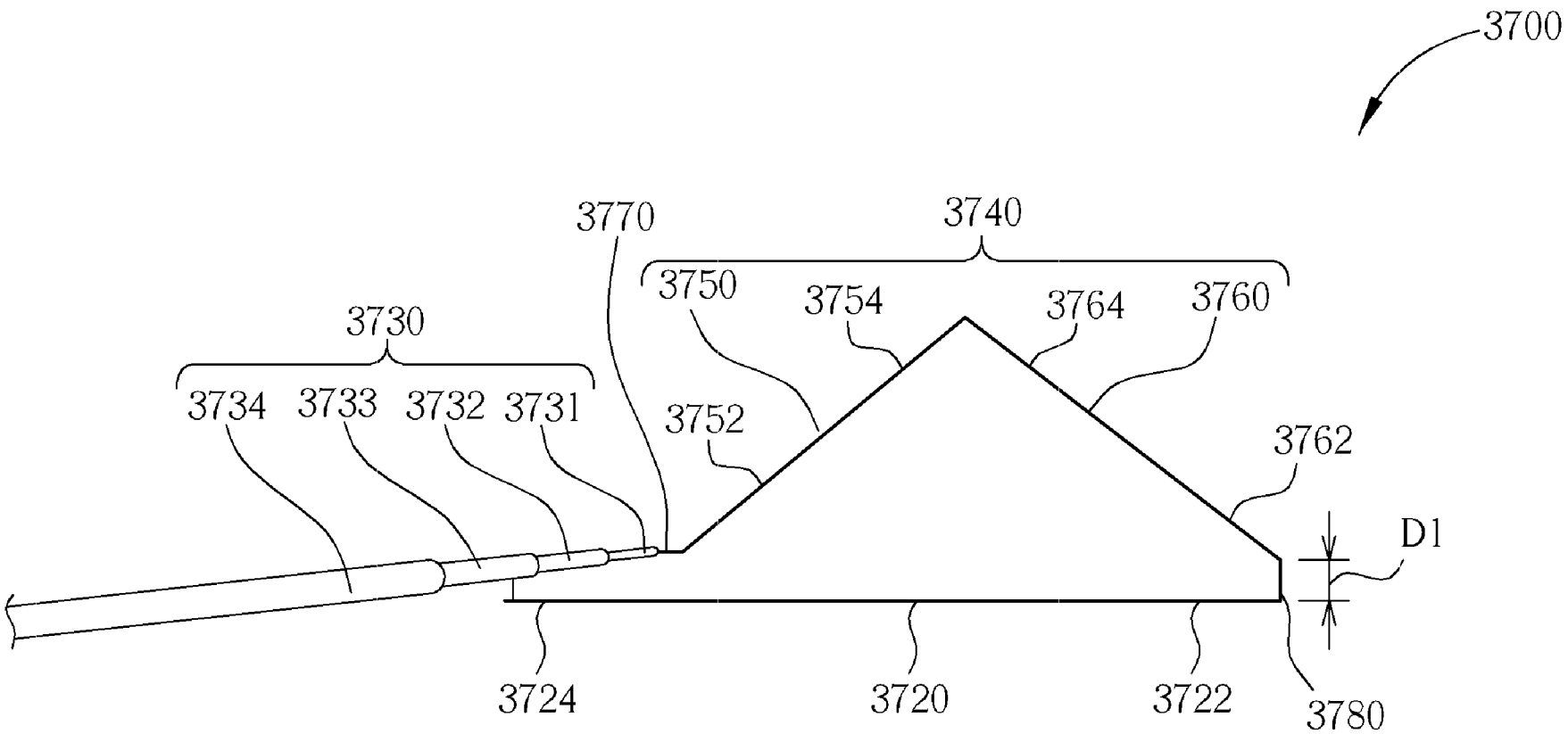
FIG. 37 is a side view of a three-dimensional antenna according to another embodiment of the present invention.

Please refer to FIG. 37. FIG. 37 is a side view of a three-dimensional antenna 3700 according to another embodiment of the present invention. As shown in FIG. 37, the three-dimensional antenna 3700 includes a substrate 3720, a radiator 3740, a grounding element 3780, and a signal feeding element 3770. The substrate 3720 includes a first end 3722 and a second end 3724. The radiator 3740 includes a first child radiator 3750 and a second child radiator 3760. The first child radiator 3750 has a first end 3752 and a second end 3754. The second child radiator 3760 has a first end 3762 and a second end 3764, wherein the second end 3764 of the second child radiator 3760 is coupled to the second end 3754 of the first child radiator 3750. The grounding element 3780 is coupled between the first end 3722 of the substrate 3720 and the first end 3762 of the second child radiator 3760 to form a designated spacing D1 by bending the substrate 3720. The signal feeding element 3770 is coupled to the first end 3752 of the first child radiator 3750. The first child radiator 3750 and the second child radiator 3760 form an inverted V-shape installed on the substrate 3720.

Besides, the signal feeding element 3770 is further connected to a coaxial cable 3730 having a first conductor layer 3731, a first isolation layer 3732, a second conductor layer 3733, and a second isolation layer 3734, wherein the first isolation layer 3732 covers the first conductor layer 3731 and lies in between the first conductor layer 3731 and the second conductor layer 3733, the second isolation layer 3734 covers the second conductor layer 3733. The first conductor layer 3731 is coupled to the signal feeding element 3770, and the second conductor layer 3733 is coupled to the second end 3724 of the substrate 3720. The substrate 3720 includes dielectric material and is connected to a system ground terminal electrically. The three-dimensional antenna 3700 is installed inside a wireless communication device, such as a wireless access point (WAP).

Figure 38:
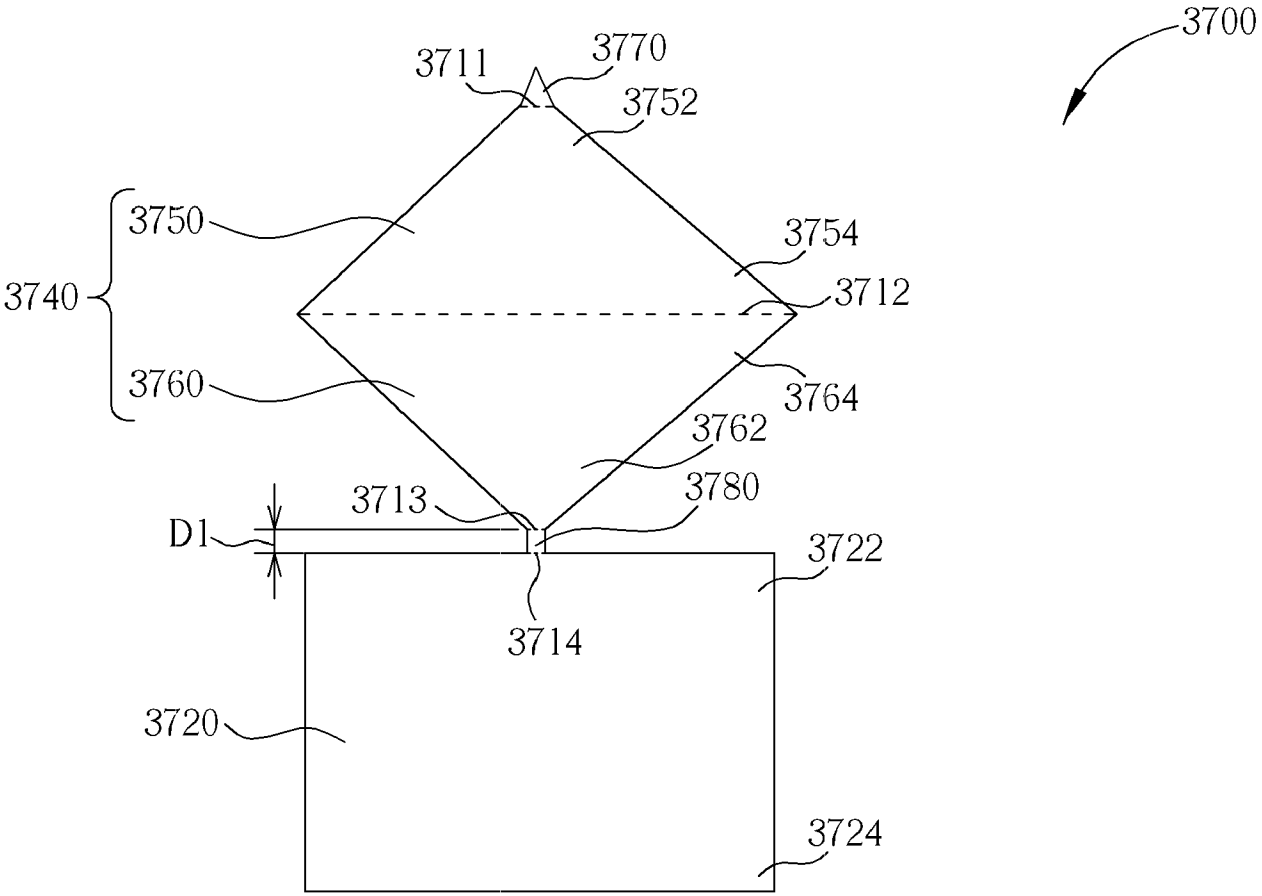
FIG. 38 is a stretched-out view of the three-dimensional antenna in FIG. 37.

Please refer to FIG. 38. FIG. 38 is a stretched-out view of the three-dimensional antenna 3700 in FIG. 37. As can be seen from FIG. 38, the substrate 3720, the first child radiator 3750, the second child radiator 3760, the grounding element 3780, and the signal feeding element 3770 are monolithically formed together. In other words, the substrate 3720, the first child radiator 3750, the second child radiator 3760, the grounding element 3780, and the signal feeding element 3770 are substantially composed of a single metal sheet, wherein the grounding element 3780 is formed by bending the metal sheet to form the designated spacing D1 between the first end 3722 of the substrate 3720 and the first end 3762 of the second child radiator 3760. In addition, dot lines 3711~3714 represents the positions of the bends. Because the three-dimensional antenna 3700 replaces traditional soldering by using a one-piece formed architecture and bending the substrate 3720 to form the grounding element 3780, the yield rate in the manufacturing process can be substantially improved.

Figure 39:
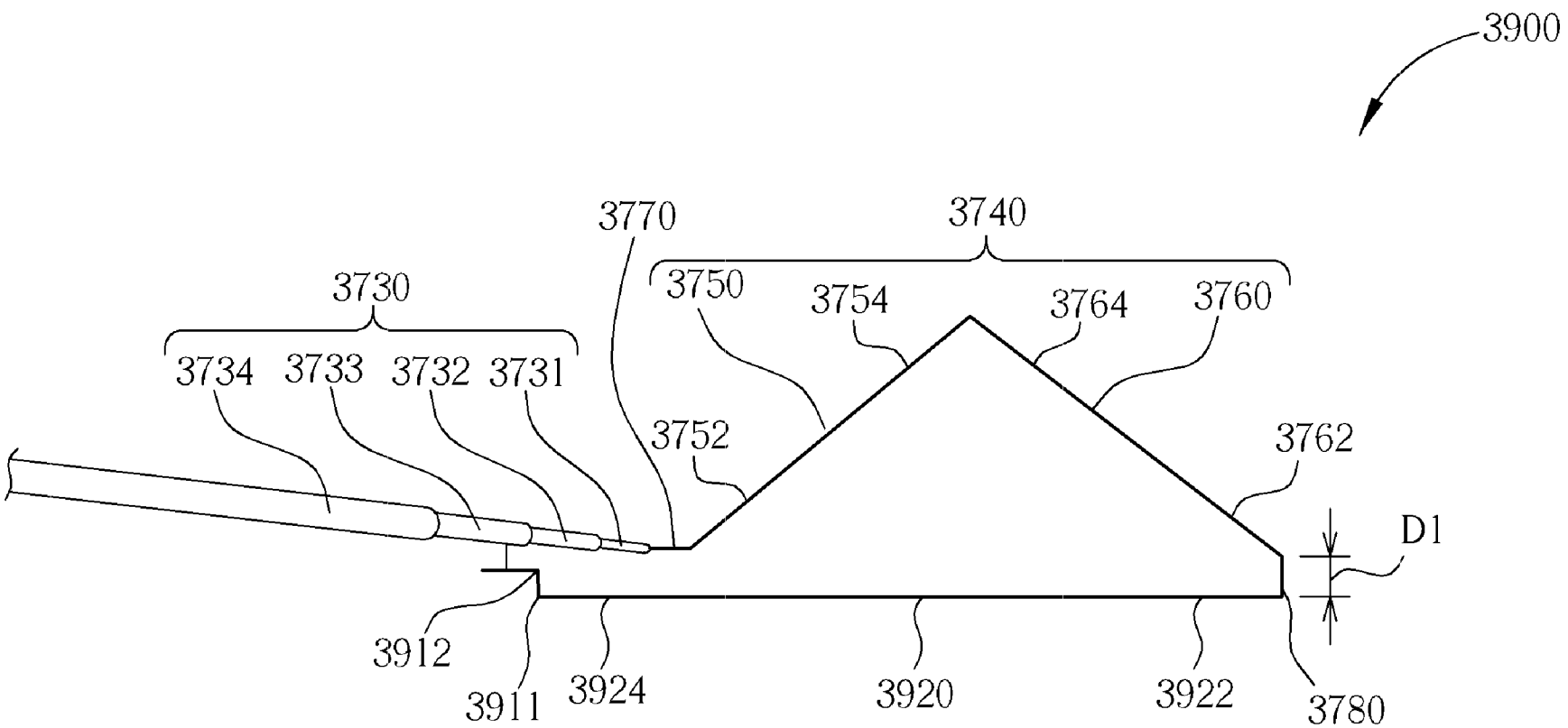
FIG. 39 is a side view of a three-dimensional antenna according to another embodiment of the present invention.
Figure 40:
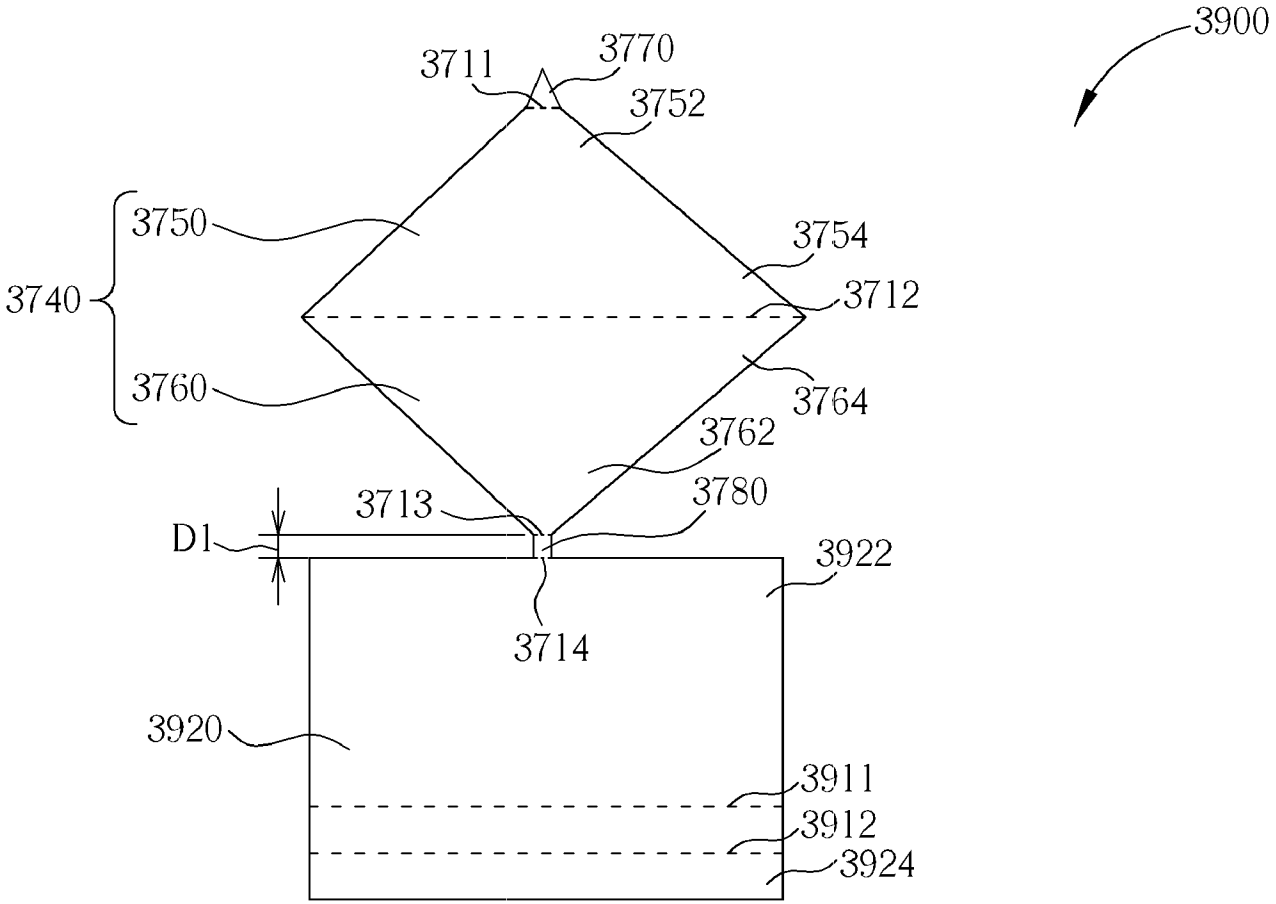
FIG. 40 is a stretched-out view of the three-dimensional antenna in FIG. 39.

Please refer to FIG. 39 and FIG. 40. FIG. 39 is a side view of a three-dimensional antenna 3900 according to another embodiment of the present invention, which is a changed form of the three-dimensional antenna 3700 shown in FIG. 37. The architecture of the three-dimensional antenna 3900 in FIG. 39 is similar to the three-dimensional antenna 3700 in FIG. 37. The difference between them is that a second end 3924 of a substrate 3920 in FIG. 39 further includes at least one bend 3911 and 3912. FIG. 40 is a stretched-out view of the three-dimensional antenna 3900 in FIG. 39. As can been seen from FIG. 40, the substrate 3920 includes a second end 3924 and dot lines 3911~3912 represents the positions of the bends.

Figure 41:
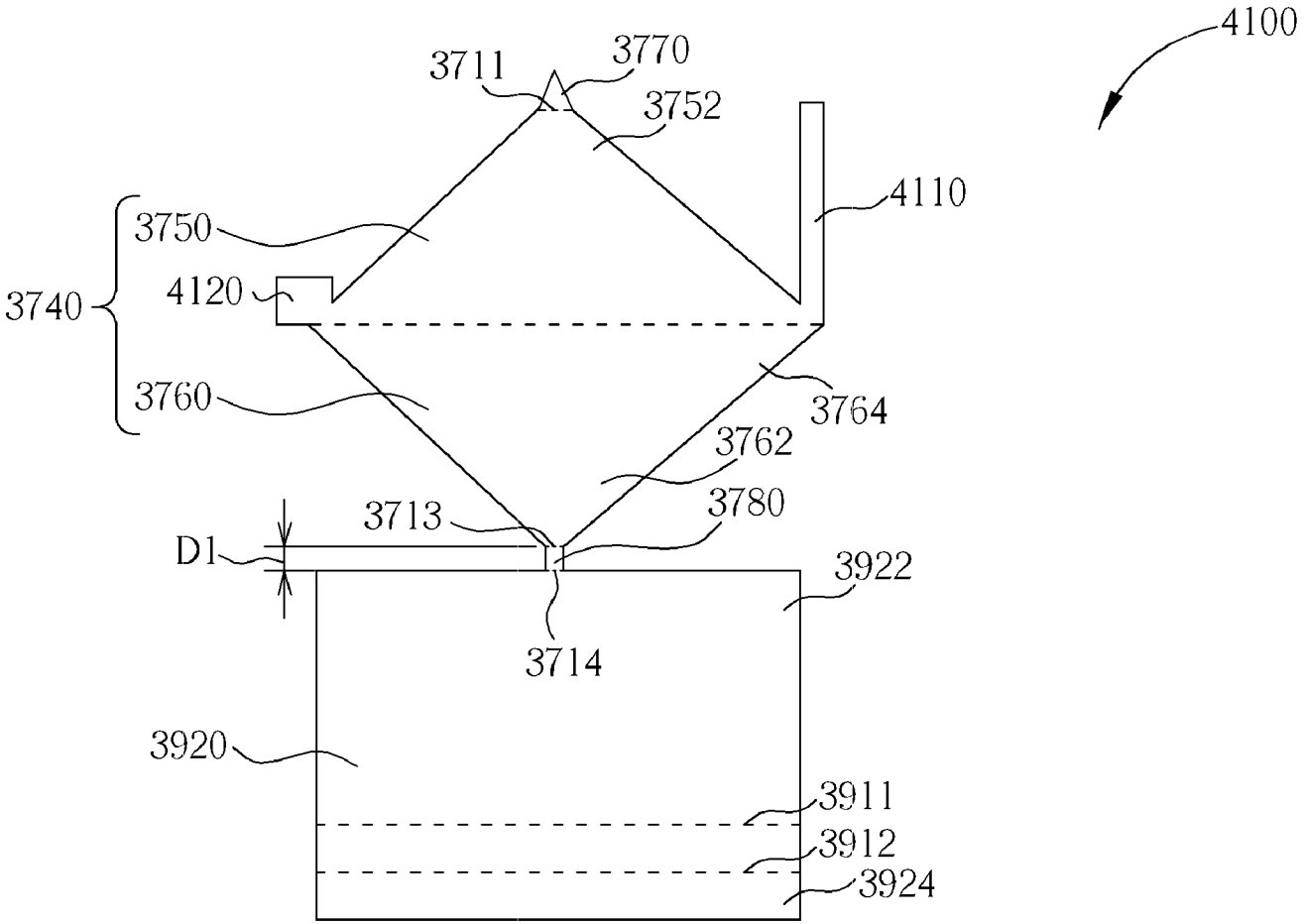
FIG. 41 is a stretched-out view of a three-dimensional antenna according to another embodiment of the present invention.

Please refer to FIG. 41. FIG. 41 is a stretched-out view of a three-dimensional antenna 4100 according to another embodiment of the present invention, which is a changed form of the three-dimensional antenna 3900 shown in FIG. 39. The architecture of the three-dimensional antenna 4100 in FIG. 41 is similar to the three-dimensional antenna 3900 in FIG. 39. The difference between them is that the three-dimensional antenna 4100 further includes a second radiator 4110 coupled to the radiator 3740 and a match element 4120 coupled to the radiator 3740 for matching the impedance of the three-dimensional antenna 4100. In this embodiment, the substrate 3920, the first child radiator 3750, the second child radiator 3760, the grounding element 3780, the signal feeding element 3770, the second radiator 4110, and the match element 4120 are monolithically formed together and substantially composed of a single metal sheet.

Figure 42:
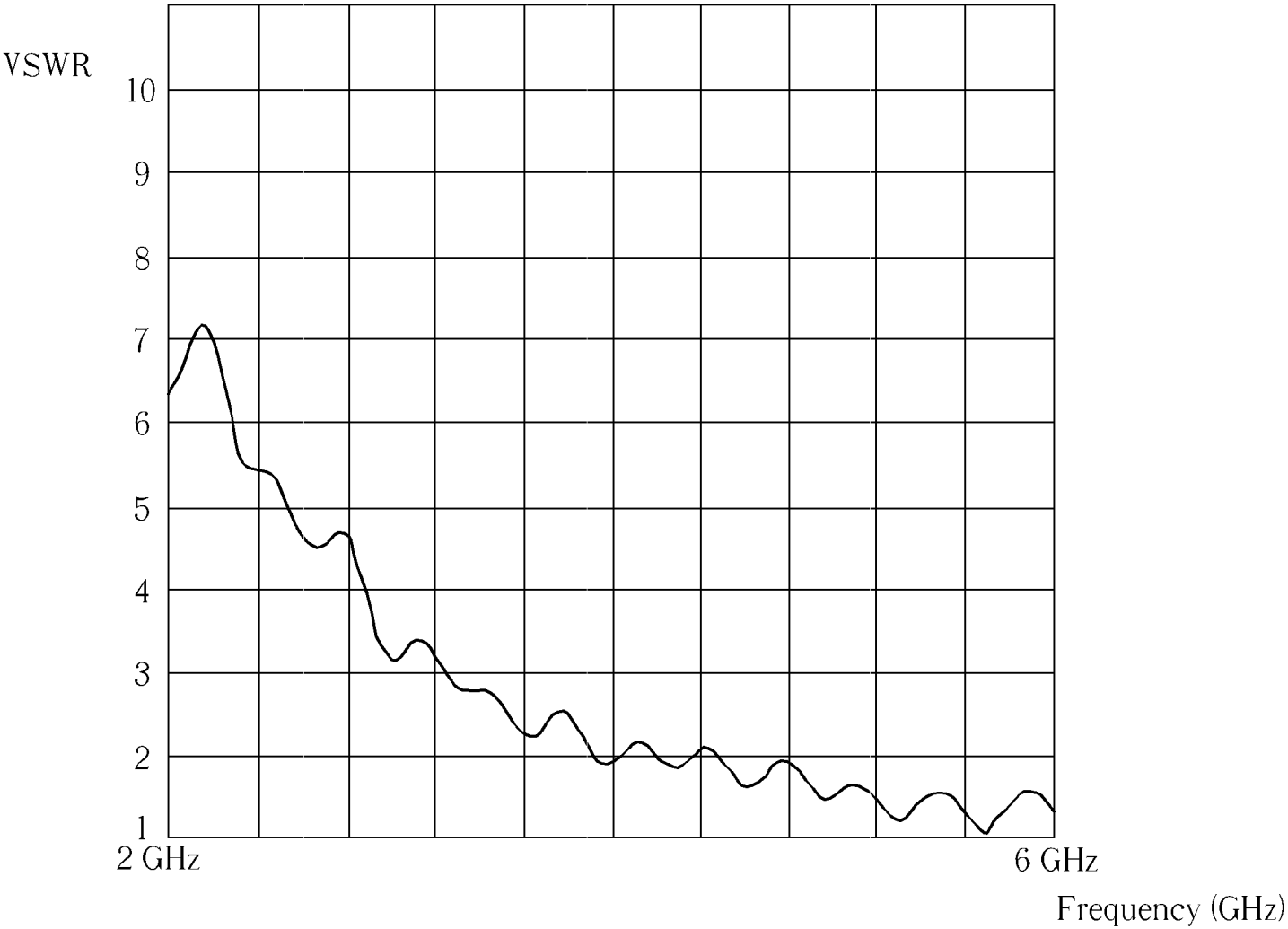
FIG. 42 is a diagram illustrating the VSWR of the three-dimensional antenna in FIG. 39.

Please refer to FIG. 42. FIG. 42 is a diagram illustrating the VSWR of the three-dimensional antenna 3900 in FIG. 39. The horizontal axis represents frequency (GHz) that distributes from 2 GHz to 6 GHz, and the vertical axis represents VSWR.

Figure 43:
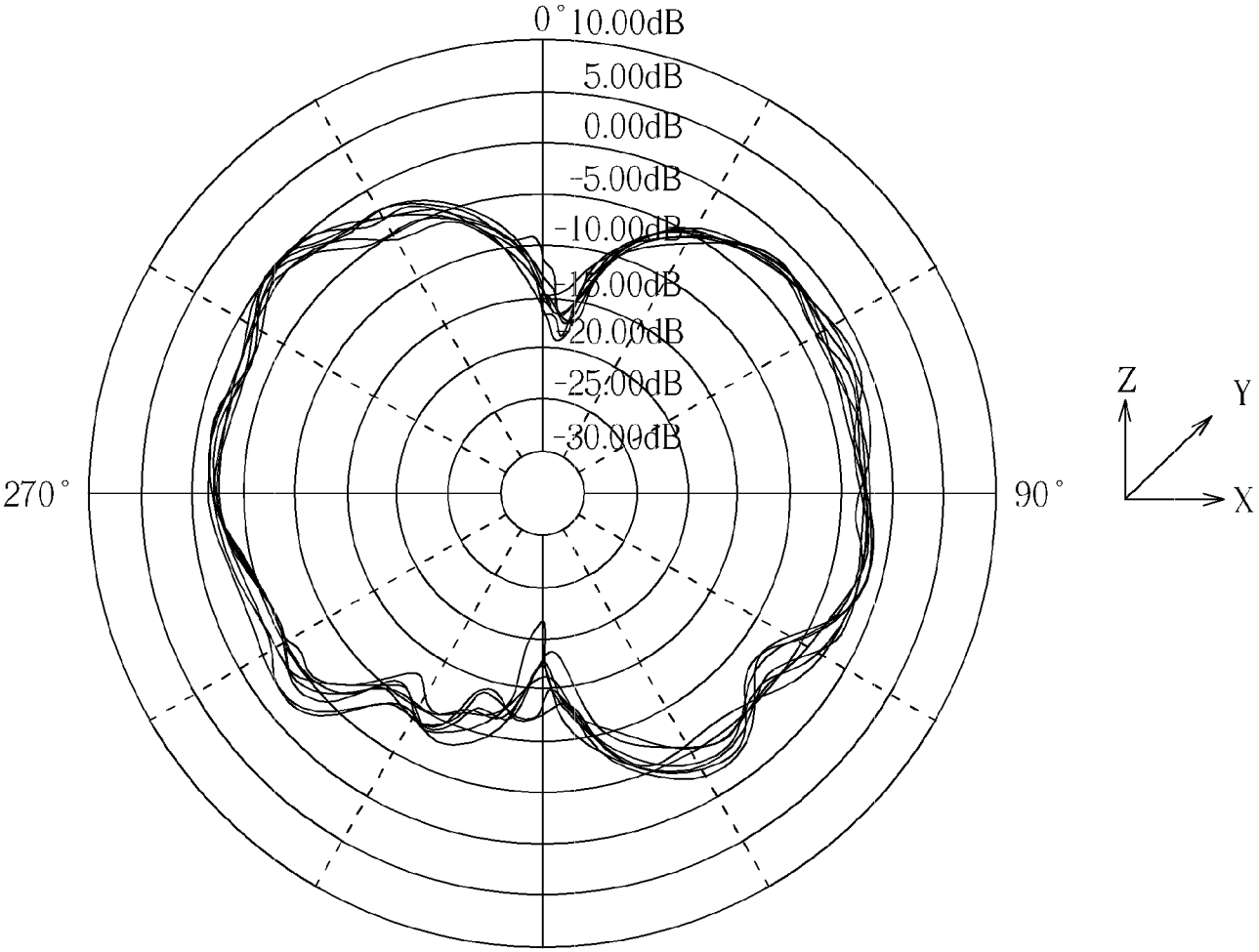
FIG. 43 is a diagram of a radiation pattern of the three-dimensional antenna in FIG. 39.

Please refer to FIG. 43 and FIG. 44. FIG. 43 represents measuring results of the three-dimensional antenna 3900 in the XZ plane, which has an operational frequencies of 5 GHz. FIG. 44 is a diagram showing the positions and the values of the maximum values and the minimum values in FIG. 43. As shown in FIG. 43 and FIG. 44, the positions of the maximum values approximately fall in (−51°~−45°), which have an approximate value range of about −1 dB~0.5 dB. The positions of the minimum values approximately fall in (−180°~−177°) and (2.8°~5.7°), which have a value of about (−21 dB~−16 dB).

Figure 45:
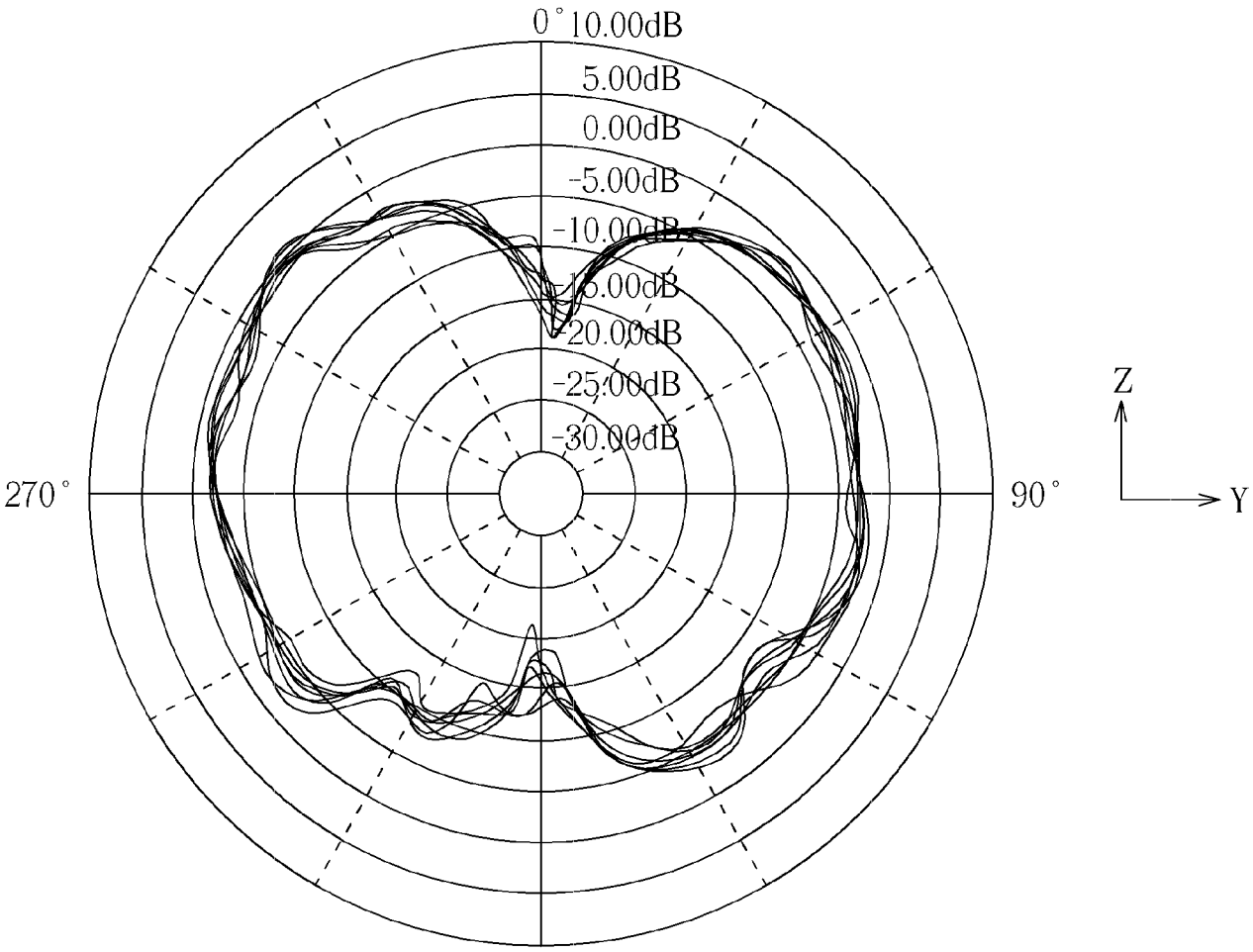
FIG. 45 is a diagram of another radiation pattern of the three-dimensional antenna in FIG. 39.

Please refer to FIG. 45 and FIG. 46. FIG. 45 represents measuring results of the three-dimensional antenna 3900 in the YZ plane, which has an operational frequencies of 5 GHz. FIG. 46 is a diagram showing the positions and the values of the maximum values and the minimum values in FIG. 45. As shown in FIG. 45 and FIG. 46, the positions of the maximum values approximately fall in (−130°) and (90°~125°), which have an approximate value range of about 0.5 dB~1.8 dB. The positions of the minimum values approximately fall in (−180°~−177°) and (2.86°), which have a value of about (−20 dB~−16 dB).

The abovementioned embodiments are presented merely to illustrate practicable designs of the present invention, and in no way should be considered to be limitations of the scope of the present invention. Those skilled in the art should appreciate that various modifications of the antennas shown in FIG. 1-FIG. 41 may be made without departing from the spirit of the present invention. For example, the antennas shown in FIG. 1-FIG. 41 can be arranged or combined randomly into a new varied embodiment.

From the above descriptions, the present invention provides a three-dimensional antenna and related wireless communication devices utilizing a metal sheet (as well as its changed forms) installed on a substrate. The VSWR, the operational frequency, and the radiation patterns of the three-dimensional antennas can be adjusted by adding the second radiator and the match element. Furthermore, the grounding element can be formed by using a one-piece formed architecture and bending the substrate to replace traditional soldering, the yield rate in the manufacturing process can be substantially improved. Various modifications of the antennas shown in FIG. 1-FIG. 41 may be made without departing from the spirit of the present invention. In other words, any changed form or any combination of the abovementioned antennas should also belong to the scope of the present invention. Through the three-dimensional antenna disclosed in the present invention, not only the operational frequencies and the radiation patterns can be controlled to conform to demands for wireless communication system, but manufacturing cost can also be effectively saved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A three-dimensional antenna, comprising:

a substrate;

a radiator, installed on the substrate, the radiator comprising:

a first child radiator, having a first end and a second end; and a second child radiator, having a first end and a second end, the second end of the second child radiator coupled to the second end of the first child radiator;

a second radiator, coupled to the radiator;

a signal feeding element, coupled to the first end of the first child radiator; and a grounding element, coupled between the substrate and the first end of the second child radiator;

wherein the first child radiator and the second child radiator form an inverted V-shape installed on the substrate.

2. The three-dimensional antenna of claim 1, wherein the second radiator comprises at least one bend.

3. The three-dimensional antenna of claim 1, wherein the second radiator is approximately parallel to the substrate.

4. The three-dimensional antenna of claim 1, wherein the second radiator and the first child radiator extend to in opposite directions.

5. The three-dimensional antenna of claim 1, wherein the second radiator and the second child radiator extend to in opposite directions.

6. The three-dimensional antenna of claim 1, further comprising a coaxial cable, having a first conductor layer, a first isolation layer, a second conductor layer, and a second isolation layer, wherein the first isolation layer covers the first conductor layer and lies in between the first conductor layer and the second conductor layer, the second isolation layer covers the second conductor layer, the first conductor layer is coupled to the signal feeding element of the three-dimensional antenna, and the second conductor layer is coupled to the substrate of the three-dimensional antenna.

7. The three-dimensional antenna of claim 1, further comprising a match element coupled to the second end of the first child radiator and the second end of the second child radiator for matching the impedance of the three-dimensional antenna.

8. The three-dimensional antenna of claim 7, wherein the first child radiator, the second child radiator, the second radiator, and the match element are substantially composed of a single metal sheet.

9. The three-dimensional antenna of claim 1, wherein the first child radiator, the second child radiator, and the second radiator are substantially composed of a single metal sheet.

10. A three-dimensional antenna, comprising:

a substrate, having a first end and a second end;

a radiator, comprising:

a first child radiator, having a first end and a second end; and a second child radiator, having a first end and a second end, the second end of the second child radiator coupled to the second end of the first child radiator;

a grounding element, coupled between the first end of the substrate and the first end of the second child radiator to form a designated spacing by bending the substrate; and a signal feeding element, coupled to the first end of the first child radiator;

wherein the first child radiator and the second child radiator form an inverted V-shape installed on the substrate.

11. The three-dimensional antenna of claim 10, wherein the substrate, the first child radiator, the second child radiator, the grounding element, and the signal feeding element are monolithically formed together.

12. The three-dimensional antenna of claim 10, wherein the substrate, the first child radiator, the second child radiator, the grounding element, and the signal feeding element are substantially composed of a single metal sheet.

13. The three-dimensional antenna of claim 12, wherein the grounding element is formed by bending the metal sheet to form the designated spacing between the first end of the substrate and the first end of the second child radiator.

14. The three-dimensional antenna of claim 10, wherein the second end of the substrate is connected to a system ground terminal electrically.

15. The three-dimensional antenna of claim 10, further comprising a coaxial cable, having a first conductor layer, a first isolation layer, a second conductor layer, and a second isolation layer, wherein the first isolation layer covers the first conductor layer and lies in between the first conductor layer and the second conductor layer, the second isolation layer covers the second conductor layer, the first conductor layer is coupled to the signal feeding element of the three-dimensional antenna, and the second conductor layer is coupled to the second end of the substrate of the three-dimensional antenna.

16. The three-dimensional antenna of claim 10, wherein the second end of the substrate further comprises at least one bend.

17. The three-dimensional antenna of claim 10, further comprising:

a second radiator, coupled to the radiator.

18. The three-dimensional antenna of claim 17, wherein the substrate, the radiator, the second radiator, the grounding element, and the signal feeding element are substantially composed of a single metal sheet.

19. The three-dimensional antenna of claim 17, further comprising a match element coupled to the second end of the first child radiator and the second end of the second child radiator for matching the impedance of the three-dimensional antenna.

20. The three-dimensional antenna of claim 19, wherein the substrate, the first child radiator, the second child radiator, the second radiator, the grounding element, the signal feeding element, and the match element are substantially composed of a single metal sheet.

21. A wireless communication device with three-dimensional antennas, the wireless communication device comprising:

a system circuit; and a plurality of three-dimensional antennas coupled to the system circuit, each three-dimensional antenna comprising:

a substrate;

a radiator, installed on the substrate, the radiator comprising:

a first child radiator, having a first end and a second end; and a second child radiator, having a first end and a second end, the second end of the second child radiator coupled to the second end of the first child radiator;

a second radiator, coupled to the radiator;

a signal feeding element, coupled to the first end of the first child radiator; and a grounding element, coupled between the substrate and the first end of the second child radiator;

wherein the first child radiator and the second child radiator form an inverted V-shape installed on the substrate.

22. A wireless communication device with three-dimensional antennas, the wireless communication device comprising:

a system circuit; and a plurality of three-dimensional antennas coupled to the system circuit, each three-dimensional antenna comprising:

a substrate, having a first end and a second end;

a radiator, comprising:

a first child radiator, having a first end and a second end; and a second child radiator, having a first end and a second end, the second end of the second child radiator coupled to the second end of the first child radiator;

a grounding element, coupled between the first end of the substrate and the first end of the second child radiator to form a designated spacing by bending the substrate; and a signal feeding element, coupled to the first end of the first child radiator;

wherein the first child radiator and the second child radiator form an inverted V-shape installed on the substrate.

* * * * *